US008243951B2

(12) United States Patent
Ishibashi et al.

(10) Patent No.: US 8,243,951 B2
(45) Date of Patent: Aug. 14, 2012

(54) SOUND EMISSION AND COLLECTION DEVICE

(75) Inventors: Toshiaki Ishibashi, Fukuroi (JP); Kosuke Saito, Hamamatsu (JP)

(73) Assignee: Yamaha Corporation (JP)

( * ) Notice: Subject to any disclaimer, the term of this patent is extended or adjusted under 35 U.S.C. 154(b) by 995 days.

(21) Appl. No.: 12/095,652

(22) PCT Filed: Dec. 15, 2006

(86) PCT No.: PCT/JP2006/325063
§ 371 (c)(1),
(2), (4) Date: May 30, 2008

(87) PCT Pub. No.: WO2007/072757
PCT Pub. Date: Jun. 28, 2007

(65) Prior Publication Data

US 2010/0166212 A1 Jul. 1, 2010

(30) Foreign Application Priority Data

Dec. 19, 2005 (JP) ..... 2005-364617
Dec. 21, 2005 (JP) ..... 2005-368052

(51) Int. Cl.
*H04R 3/00* (2006.01)

(52) U.S. Cl. ..... 381/92

(58) Field of Classification Search ..... None
See application file for complete search history.

(56) References Cited

U.S. PATENT DOCUMENTS 2,424,634 A * 7/1947 Rieber ..... 381/66
3,694,578 A 9/1972 Reid
5,778,085 A 7/1998 Sasaki
6,173,059 B1 1/2001 Huang et al.
2004/0252849 A1* 12/2004 Johnston et al. ..... 381/92
2005/0093970 A1 5/2005 Abe et al.
2005/0094795 A1 5/2005 Rambo
2006/0132595 A1* 6/2006 Kenoyer et al. ..... 348/14.08
2007/0025560 A1* 2/2007 Asada ..... 381/61

FOREIGN PATENT DOCUMENTS

JP 56-39667 A 4/1981
JP 58-56563 A 4/1983
JP 61-035699 A 2/1986

(Continued)

OTHER PUBLICATIONS

Japanese Office Action corresponding to JP 2005-364617, mailed Apr. 19, 2011. English language translation provided.
Japanese Office Action corresponding to JP 2005-368052, mailed Apr. 26, 2011. English language translation of Japanese OA provided. References in OA previously cited in IDS dated Jun. 19, 2008.
International Search Report issued in corresponding PCT/JP2006/325063. No English translation readily available.

(Continued)

*Primary Examiner* — Hrayr A Sayadian
(74) *Attorney, Agent, or Firm* — Rossi, Kimms & McDowell LLP

(57) ABSTRACT

It is possible to provide a sound emission and collection device having a compact configuration and being capable of suppressing a wraparound sound from a speaker to a microphone and improving the S/N ratio. In the sound emission and collection device, a plurality of speakers (11) have a sound emission surface arranged on the side surface of a case (1) so that a sound can be emitted in all circumferential directions of the sound emission and collection device. Each of the microphones (12) is arranged with the sound collection direction set in the center direction of the case (1). The microphone (12) and the speaker (11) have directivities opposing to each other. Accordingly, it is possible to minimize a wraparound sound from the speaker (11) to the microphone (12). Moreover, since the speaker (11) and the microphone (12) are arranged on circumferences of concentric circles, it is possible to obtain a compact configuration.

9 Claims, 24 Drawing Sheets

FOREIGN PATENT DOCUMENTS

| | | | |
|---|---|---|---|
| JP | 63-22702 | A | 1/1988 |
| JP | 01-162465 | A | 6/1989 |
| JP | 2-288455 | A | 11/1990 |
| JP | 05-070094 | U | 9/1993 |
| JP | 8-204803 | A | 8/1996 |
| JP | 8-298696 | A | 11/1996 |
| JP | 2000-253134 | A | 9/2000 |
| JP | 2005-65217 | A | 3/2005 |
| JP | 2005-101800 | A | 4/2005 |

OTHER PUBLICATIONS

Decision of Rejection issued in corresponding Japanese patent application No. JP2005-368052, dated Aug. 23, 2011. English translation is provided.

Decision of Rejection issued in corresponding Japanese patent application No. JP2005-364617, dated Aug. 23, 2011. English translation is provided.

Extended European Search Report for EP 06842831.7, dated Mar. 19, 2012.

* cited by examiner

SOUND EMISSION AND COLLECTION DEVICE

TECHNICAL FIELD

This application is a U.S. National Phase Application of PCT International Application PCT/JP2006/325063 and claims priority from Japanese Patent Application No. 2005-364617, filed Dec. 19, 2005, and Japanese Patent Application No. 2005-368052, filed Dec. 21, 2005, the contents of which are all incorporated herein by reference, and relates to a sound emission and collection device integrally including speakers and microphones, and more particularly to a sound emission and collection device having a compact configuration and capable of suppressing a wraparound sound from a speaker to a microphone.

BACKGROUND ART

As an audio communication system for performing an audio conference (conference call) in a remote location, an audio conference device integrally including a speaker and a microphone has been released. The audio conference device transmits a sound signal collected by the microphone to a connection destination and emits a sound signal, received from the connection destination, from the speaker. When the conference is held by a plurality of persons, such an audio conference device is usually installed in the center of conference participants (the center of a conference desk or the like). Therefore, it is desirable to miniaturize this audio conference device, and for example, an audio conference device miniaturized by omitting a speaker box as shown in Patent Document 1 has been proposed.

When a sound signal received from the connection destination is emitted from the speaker since the audio conference device is configured to have the speaker and the microphone within the same space, such a sound is collected as an echo to the microphone and a collected sound signal including the echo is transmitted to the connection destination. In an audio conference device having an echo canceller function as shown in Patent Document 2, an audio conference device for accommodating the microphone at the tip end of a tube-shaped elastic body and suppressing acoustic coupling between the speaker and the microphone has been proposed.

However, in the configuration of Patent Document 1, a compact configuration is provided, but the speaker and the microphone are close to each other and the amount of wraparound sound from the speaker to the microphone is large. On the other hand, in the configuration of Patent Document 2, the wraparound sound is suppressed by the echo canceller function and the acoustic coupling inside the case is suppressed by the elastic body, but the speaker and the microphone are still close to each other for a compact configuration as in Patent Document 1. For this reason, there is still a problem in that a sound emitted from the speaker is apt to wrap around the microphone and a heavy processing burden is imposed on the echo canceller function.

An object of the present invention is to provide a sound emission and collection device having a compact configuration and being capable of suppressing a wraparound sound from a speaker to a microphone and improving an S/N ratio.

[Patent Document 1] Japanese Patent Application, First Publication No. 8-204803

[Patent Document 2] Japanese Patent Application, First Publication No. 8-298696

DISCLOSURE OF INVENTION

A sound emission and collection device of the present invention includes: a plurality of unidirectional microphones arranged toward a center on a circumference of a first circle in which one axis is set as the center; and a plurality of speakers arranged toward a direction opposite the center on a circumference of a second circle in which the axis is set as the center.

In the present invention, the plurality of unidirectional microphones and speakers are respectively installed on the circumferences in which the same axis is set as the center. The directivities of the unidirectional microphone and the speaker are installed in opposite directions. Therefore, a wraparound sound from the speaker to the unidirectional microphone can be suppressed. Since both the speaker and the unidirectional microphone are installed on the circumferences in which the same axis is set as the center, a compact configuration is provided.

In the present invention, it is preferable that the circumference of the first circle have a larger diameter than the circumference of the second circle.

In the present invention, it is preferable to further include a case on which the plurality of unidirectional microphones and the plurality of speakers are arranged, wherein the plurality of unidirectional microphones are arranged on an upper surface of the case, and the plurality of speakers are arranged on a side surface side of the case.

In the present invention, it is preferable to further include signal processing means that estimates a sound source direction based on a level of a sound signal collected by each unidirectional microphone and outputs, to a rear stage, a sound signal collected by the unidirectional microphone toward the sound source direction.

In the above-mentioned configuration, a signal having a highest sound pressure level is selectively output among sound signals collected in the respective unidirectional microphones. Thereby, an S/N ratio can be further improved.

In the present invention, the signal processing means may further estimate a sound source direction by adding sound signals collected by a plurality of adjacent unidirectional microphones and output a signal achieved by adding the sound signals collected by the plurality of adjacent unidirectional microphones to the rear stage.

In the above-mentioned configuration, sound signals collected from adjacent unidirectional microphones are added in each unidirectional microphone. Moreover, a signal having the highest sound pressure level is selectively output among the added sound signals. Thereby, an S/N ratio can be further improved.

Preferably, the sound emission and collection device of the present invention further includes: a case having two facing surfaces; and a sound emission surface parallel to a second surface facing a first surface of the case, wherein the unidirectional microphone is arranged on a first surface side of the case, a center of the sound emission surface and a center of the circle are on the same perpendicular line with respect to the first surface and the second surface, and the speaker emits a sound from the second surface to the outside of the case.

In this configuration, a sound emitted from the speaker installed on the second surface side which is the sound emission surface is reflected on a top surface of a desk on which the sound emission and collection device is installed and is propagated to a side surface side of the case. On this occasion, the strengths of sounds propagated to portions of the side surface are substantially identical. Thus, a part of the sound emitted from the speaker wraps around the first surface side on which the plurality of unidirectional microphones are installed via the side surface.

Each of the plurality of unidirectional microphones is arranged on the first surface side in a circumferential shape. On this occasion, the center of the sound emission surface and the circle center are on the same perpendicular line with respect to the first surface and the second surface, and a center direction of the circle is installed to be an axis direction of directivity, that is, a direction of high sound collection sensitivity.

For this reason, a sound wrapped around the first surface side is absent in a unidirectional microphone arranged at a position closest to a side surface position to which the sound has wrapped around, and the sound is mainly collected by a unidirectional microphone arranged at the farthest position opposite the side surface position to which the sound has wrapped around. Thereby, a propagation path of the wraparound sound (echo path) is lengthened and the wraparound sound can be significantly attenuated until the sound is collected in the unidirectional microphone.

In the sound emission and collection device of the present invention, arrangement positions of the plurality of unidirectional microphones are preferably point-symmetrical by setting the circle center as a reference point.

In this configuration, wraparound sounds to the respective unidirectional microphones are substantially identical since the arrangement positions of the plurality of unidirectional microphones are point-symmetrical.

Preferably, the sound emission and collection device of the present invention includes difference arithmetic means that generates a difference-corrected collected sound signal by performing a difference arithmetic operation on collected sound signals of each unidirectional microphone and a unidirectional microphone arranged at a point-symmetrical position with respect to the circle center, from a collected sound signal of each unidirectional microphone point-symmetrically arranged.

In this configuration, as described above, a wraparound sound collected in each unidirectional microphone is almost not varied, and particularly wraparound sounds in unidirectional microphones point-symmetrically arranged are substantially identical, such that a difference-corrected collected sound signal from which a signal component due to the wraparound sound has been removed can be obtained when a subtraction operation is performed on the collected sound signals of the unidirectional microphones.

Preferably, the sound emission and collection device of the present invention includes signal processing means that detects a sound source direction based on signal strengths of collected sound signals of the plurality of unidirectional microphones and outputs, to a rear stage, a collected sound signal of a unidirectional microphone in which the directional axis is toward the sound source direction.

In this configuration, a collected sound signal of a unidirectional microphone in which a directional axis is toward the sound source direction has a higher signal strength than collected sound signals of other unidirectional microphones, that is, uses a higher sound pressure level, and a collected sound signal having the highest signal strength is selectively output among the collected sound signals of the respective unidirectional microphones. Thereby, the signal strength of a collected sound signal from the sound source direction is relatively high and a collected sound signal having a high S/N ratio can be obtained.

The sound emission and collection device of the present invention may include signal processing means that detects a sound source direction based on a signal strength of the difference-corrected collected sound signal and outputs the difference-corrected collected sound signal corresponding to the sound source direction to a rear stage.

In this configuration, a difference-corrected collected sound signal obtained by subtracting a collected sound signal of a unidirectional microphone in which the directional axis is toward an opposite direction from a collected sound signal of a unidirectional microphone in which a directional axis is toward a sound source direction is achieved because a wraparound sound component is suppressed and a collected sound signal is further enhanced in the sound source direction, such that a collected sound signal having a higher S/N ratio can be achieved by selectively outputting a difference-corrected collected sound signal of which a signal strength is highest among each difference-corrected collected sound signal, that is, of which a sound pressure level is high.

DESCRIPTION OF REFERENCE NUMERALS AND SIGNS

1: CASE
1S: CASE
11: SPEAKER
11S: CONCAVE PORTION
12: MICROPHONE
12S: INNER CIRCUMFERENCE WALL SURFACE
13: AMPLIFIER
14: A/D CONVERTER
15: MICROPHONE SIGNAL PROCESSING CIRCUIT
16: ECHO CANCELLER
17: INPUT/OUTPUT INTERFACE
18: D/A CONVERTER
19: AMPLIFIER
1P: PUNCHING METAL
100: SOUND EMISSION AND COLLECTION DEVICE
200: DESK
201, 202: USER
300: EMITTED SOUND
301, 302: VOCALIZED SOUND
1, 91: CASE
10A: FIRST SURFACE OF CASE 1
10B: SECOND SURFACE OF CASE 1
10C: SIDE SURFACE OF CASE 1
2A~2H, 92A: MICROPHONE
3: SPEAKER
4: FOOT PORTION
21A~21H: INPUT AMPLIFIER
22A~22H: A/D CONVERTER
23: MICROPHONE SIGNAL PROCESSING CIRCUIT
231A~231H, 237A~237H: ADDER
232: SELECT/MIXING CIRCUIT
233: MAXIMUM SIGNAL STRENGTH DETECTION CIRCUIT
234A~234H, 235A~235H, 236A~236H: DELAY CIRCUIT
24: ECHO CANCELLER
241: ADAPTIVE FILTER
242: ADDER
25: INPUT/OUTPUT INTERFACE
26: INPUT/OUTPUT CONNECTOR
31: D/A CONVERTER
32: OUTPUT AMPLIFIER

BEST MODE FOR CARRYING OUT THE INVENTION

First Embodiment

Figure 1:
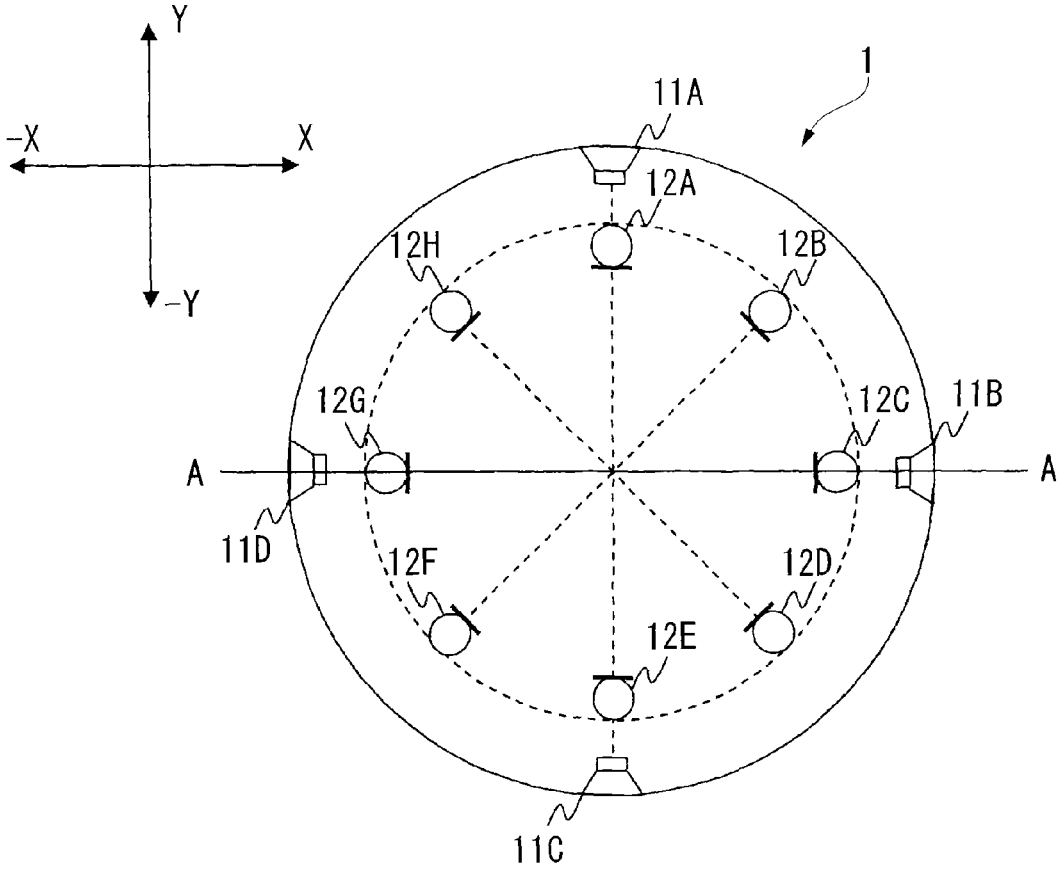
FIG. 1 is a top view of a sound emission and collection device.
Figure 2A:
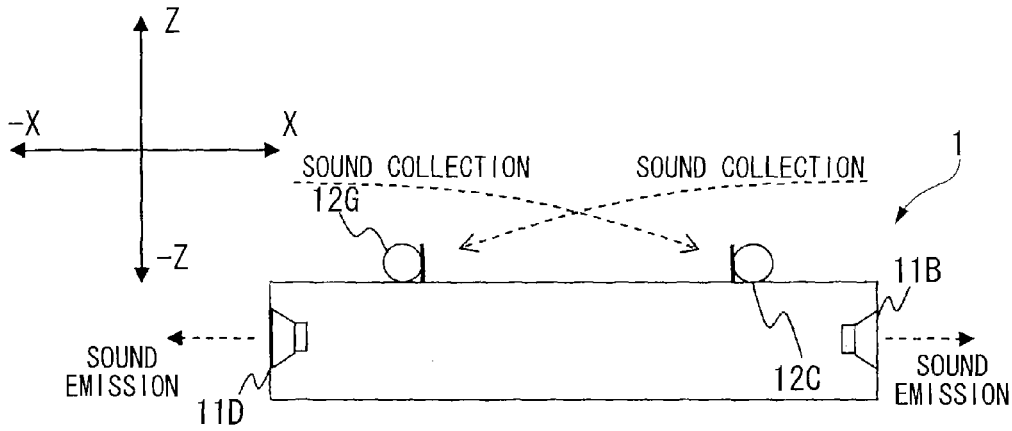
FIG. 2A is an A-A cross-sectional view of FIG. 1.

A sound emission and collection device according to an embodiment of the present invention will be described with reference to the drawings. FIG. 1 is a top view of the sound emission and collection device according to the embodiment, and FIG. 2A is an A-A cross-sectional view in FIG. 1. In FIG. 1, the right side on the paper surface is the X direction, the left side is the −X direction, the upper side is the Y direction, and the lower side is the −Y direction. In FIG. 2A, the right side on the paper surface is the X direction, the left side is the −X direction, the upper side is the Z direction, and the lower side is the −Z direction.

The sound emission and collection device includes a circular cylindrical shaped case 1, a plurality of (in this example, four) speakers 11A~11D arranged at equal intervals on a concentric circle on an outermost circumference portion of the case 1, and a plurality of (in this example, eight) microphones 12A 12H (unidirectional microphones) arranged at equal intervals on a concentric circle inside the case 1. The microphones 12A~12H are respectively connected to amplifiers 13A~13H of a front end (see FIG. 3), and output a sound signal based on a collected sound. The speakers 11A~11D are connected respectively to amplifiers 19A 19D (see FIG. 3), and emit sounds based on input sound signals.

The case 1 has a compact circular cylindrical shape in which a diameter of a cross-sectional circle when viewed from the upper surface is about 30 cm, and has a height level (for example, about 10 cm) at which a sound emission surface of the speaker 11 can be arranged on a circular cylindrical side surface.

Each speaker 11 uses a cone type speaker unit, a horn type speaker unit, or the like, but can have other forms. Each microphone 12 is a directional microphone having a strong sensitivity in a predetermined direction. The microphone 12 uses a dynamic microphone unit, a condenser microphone unit, or the like, but can have other forms.

Each speaker 11 is installed on a side surface of the case 1 such that a sound emission direction is outside the case 1, and the four speakers 11 respectively emit sounds in different directions. For example, as shown in FIG. 2, the speaker 11B emits a sound in the X direction and the speaker 11D emits a sound in the −X direction. Therefore, the speakers 11 can emit sounds in all circumferential directions of the sound emission and collection device (X, −X, Y, −Y directions).

Each microphone 12 is installed on the upper surface of the case 1 such that the sound collection direction (the direction having the high sensitivity) is a center direction (for example, the sound collection direction of the microphone 12C is the −X direction and the sound collection direction of the microphone 12G is the X direction) when viewed from the upper surface of the case 1. Since each microphone 12 has the sound collection direction being the center direction of the case 1 but the plurality of microphones 12 are installed to face each other, the microphones 12 can collect sounds in all circumferential directions (eight directions) of the sound emission and collection device.

The sound emission direction and the sound collection direction of the speaker 11 and the microphone 12 adjacent to each other (for example, the speaker 11B and the microphone 12C) are substantially opposite directions. The speaker 11 and the microphone 12 (for example, the speaker 11B and the microphone 12G) of which the sound emission and collection directions are the same direction are arranged at positions farthest from each other in the case 1. Therefore, a wraparound sound from the speaker 11 to the microphone 12 is minimized and an S/N ratio is further improved in comparison with that of a general sound emission and collection device (for example, when the sound emission surface of the speaker is the upper side of the case and the sound collection surface of the microphone is the outside of the case).

Figure 3:
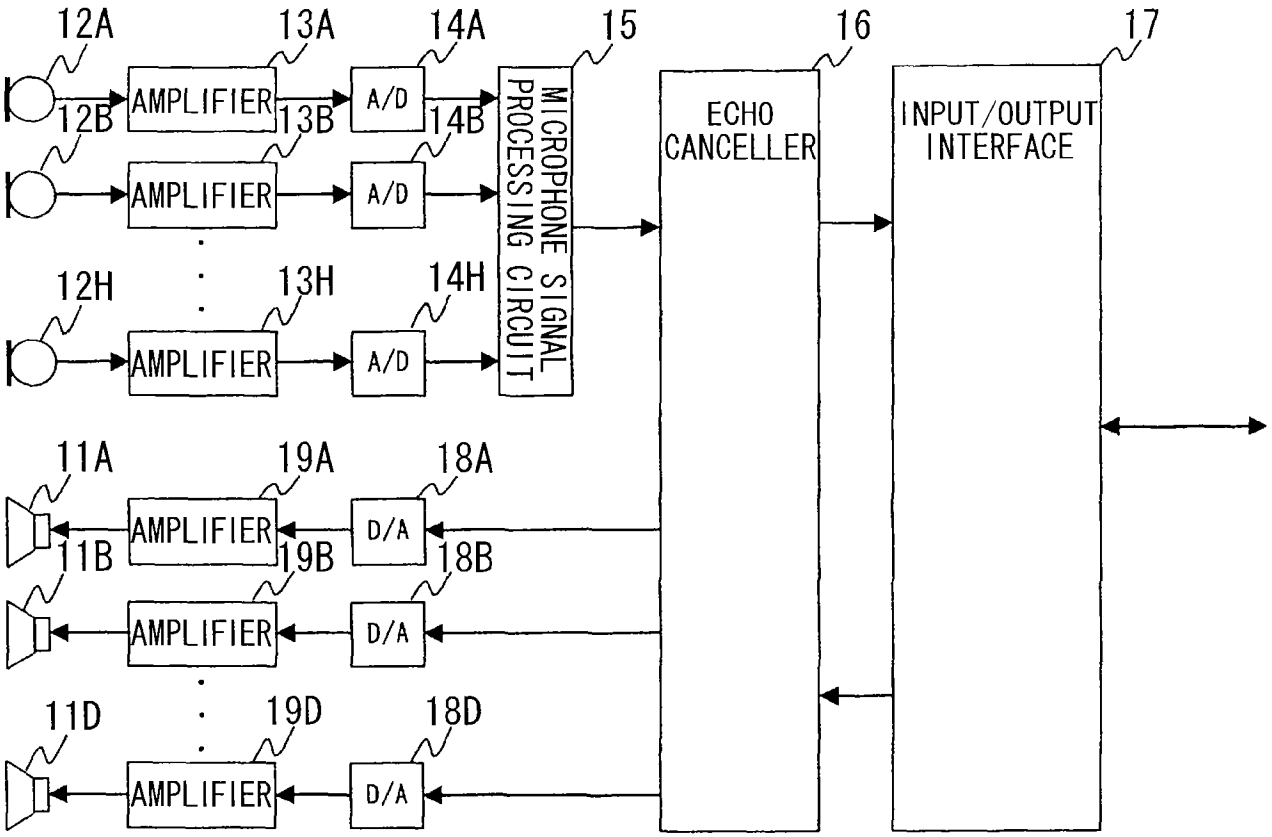
FIG. 3 is a block diagram of the sound emission and collection device.

Next, a configuration of a signal processing system of the sound emission and collection device will be described in detail with reference to FIG. 3. FIG. 3 is a block diagram showing a configuration of the sound emission and collection device. The sound emission and collection device includes the above-described speakers 11A~11D, the microphones 12A 12H, the amplifiers 13A~13H of the front end connected to the microphones 12A~12H, A/D converters 14A~14H connected to the amplifiers 13A 13H, a microphone signal processing circuit 15 connected to the A/D converters 14A~14H, an echo canceller 16 connected to the microphone signal processing circuit 15, an input/output interface 17 connected to the echo canceller 16, D/A converters 18A~18D connected to the echo canceller 16, and the amplifiers 19A~19D, connected to the D/A converters 18A~18D, for supplying sound signals to the speakers 11A~11D.

The sound signals output by the microphones 12A~12H are amplified in the amplifiers 13A~13H of the front end, and are digital-converted in the A/D converters 14A~14H. The microphone signal processing circuit 15 selects and outputs a signal of a highest sound pressure level among digital signals output from the A/D converters 14A~14H.

Figure 4:
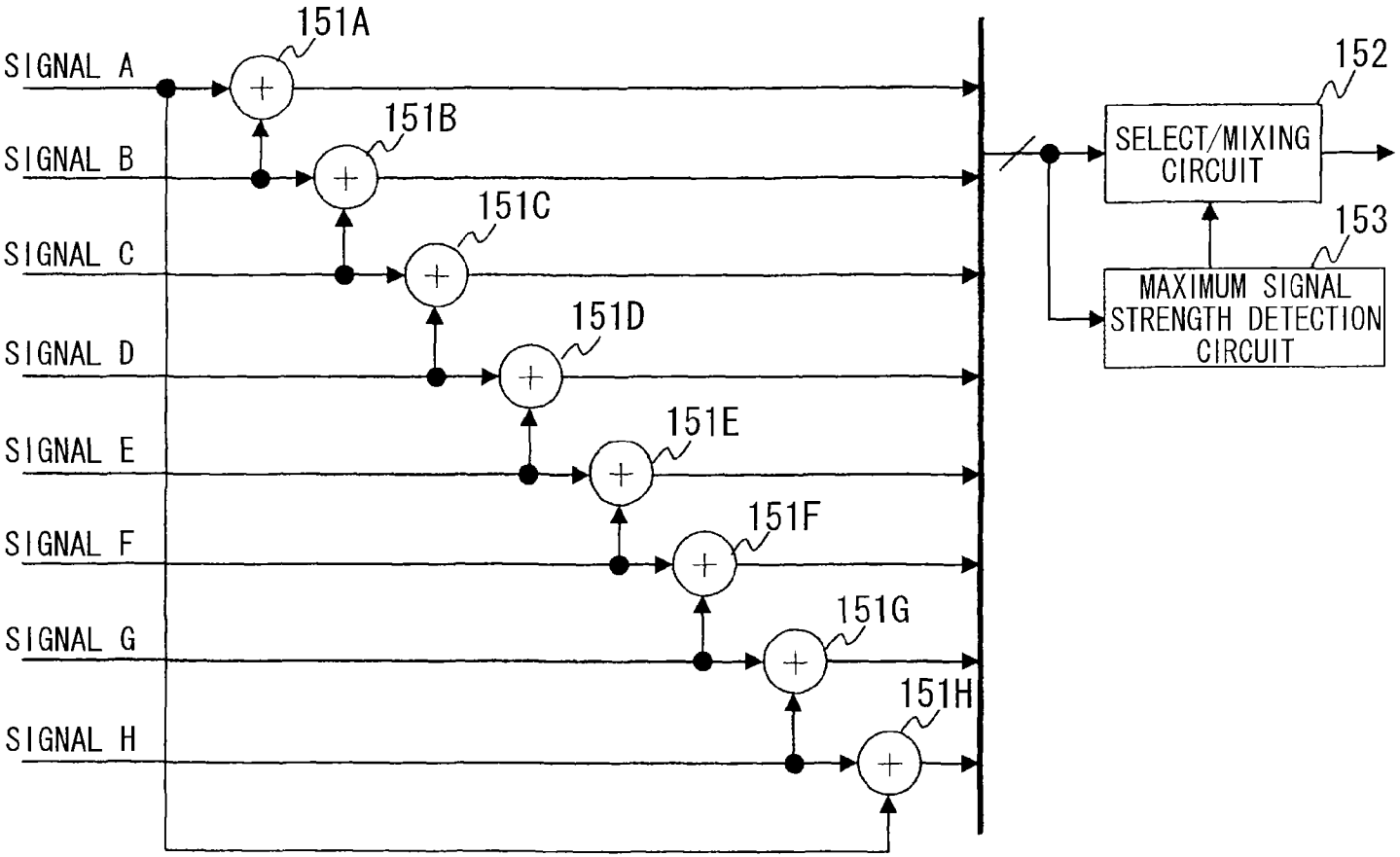
FIG. 4 is a detailed block diagram of a microphone signal processing circuit.

FIG. 4 shows a detailed block diagram of the microphone signal processing circuit 15. The microphone signal processing circuit 15 includes adders 151A~151H, a select/mixing circuit 152, and a maximum signal strength detection circuit 153. Digital signals A~H are respectively input from the A/D converters 14A~14H to the adders 151A~151H. A signal adjacent to a signal input to each adder 151 (a signal output by the microphone adjacent to the microphone corresponding to each adder is adjacent) is branched and input to each adder 151. For example, the digital signal A and the digital signal B are input to the adder 151A, and the digital signal B and the digital signal C are input to the adder 151B. Each adder 151 adds and outputs the input digital signals. By adding adjacent microphone signals, a signal of a front direction of the microphone is enhanced and a signal of the other direction is weakened, such that the directivity of the microphone is improved.

In the maximum signal strength detection circuit 153, sound pressure levels of added digital signals are compared. The maximum signal strength detection circuit 153 compares the sound pressure levels of the respective digital signals, selects a digital signal having a highest sound pressure level as a result thereof, and sets it in the select/mixing circuit 152. The select/mixing circuit 152 selects only the set digital signal and outputs it to the echo canceller 16. Moreover, the maximum signal strength detection circuit 153 may select a plurality of digital signals in sequence from the digital signal having the highest sound pressure level, such that they can be set in the select/mixing circuit 152. On this occasion, the select/mixing circuit 152 mixes and outputs the plurality of set digital signals to the echo canceller 16.

Since the signal having the highest sound pressure level or a signal achieved by mixing a plurality of signals in sequence from the signal having the highest sound pressure level is output and other low level signals are not output, an S/N ratio is further improved. In the above-described configuration, signals of the adjacent microphones 12 are added and output, but collected sound signals of the microphones 12 can be respectively independently output and two or more adjacent signals can be added and output.

An output signal of the microphone signal processing circuit 15 is input to the echo canceller 16. An output signal of the echo canceller 16 is transmitted to another device via an input/output interface 17. The input/output interface 17 has a LAN terminal, an analog audio terminal, a digital audio terminal, and the like, and transmits the above-mentioned signal to a device connected to these terminals. When outputting to the LAN terminal, sound information is transmitted to a device or the like of a remote location connected via a network. Moreover, the input/output interface 17 outputs received sound information (received signal) from another device to the echo canceller 16. The echo canceller 16 estimates a wraparound component from the speaker 11 to the microphone 12, and subtracts the estimated wraparound component from the output signal of the microphone signal processing circuit 15.

Figure 5:
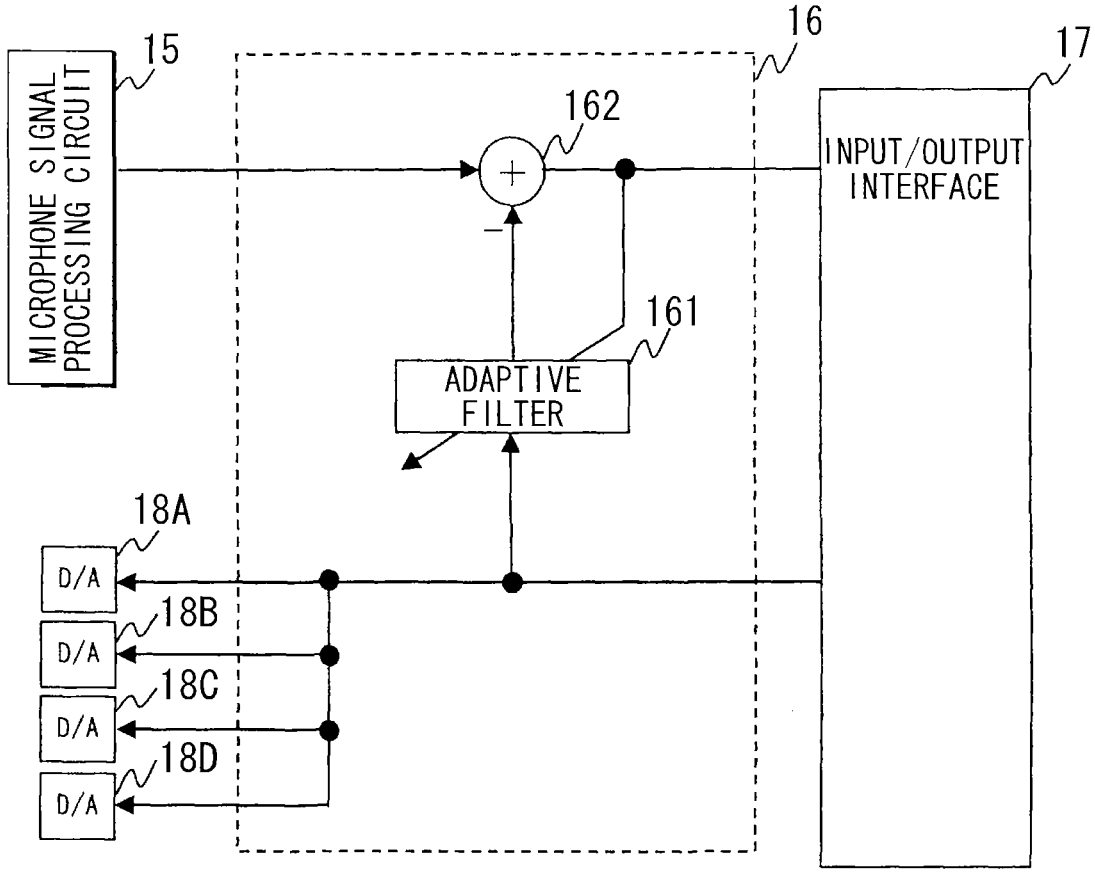
FIG. 5 is a detailed block diagram of an echo canceller.

FIG. 5 shows a detailed block diagram of the echo canceller 16. The echo canceller 16 includes an adaptive filter 161 and an adder 162. The adaptive filter 161 includes a digital filter of an FIR filter or the like. The adaptive filter 161 estimates a transfer function of an acoustic transfer system (an acoustic propagation path from the speaker 11 to the microphone 12) and computes a filter factor of the FIR filter to simulate the estimated transfer function. The adaptive filter 161 generates a simulated signal of the wraparound component from the speaker 11 to the microphone 12 by the estimated filter factor. The adder 162 subtracts the simulated signal from the output signal of the microphone signal processing circuit 15. Accordingly, an output signal of the adder 162 is a signal achieved by eliminating the wraparound component from a collected sound signal of the microphone 12.

The transfer function estimation and the filter factor computation are performed with an adaptive algorithm on the basis of a supply signal to the speaker 11 using a residual signal being a signal output from the adder 162 as a reference signal. The adaptive algorithm is an algorithm that computes the filter factor such that the residual signal is as small as possible.

Thereby, only a wraparound signal can be efficiently attenuated by generating a signal achieved by simulating a wraparound signal of an acoustic transfer system (a sound signal from the speaker 11 to the microphone 12) in the adaptive filter 161 and subtracting the simulated signal from a collected sound signal in the adder 162. Thereby, the echo canceller 16 can prevent an echo generated by a wraparound signal. When this sound emission and collection device is used as a loudspeaker that emits a sound collected by the microphone 12 from the speaker 11 via the input/output interface 17, the echo canceller 16 can prevent howling from occurring due to the loop phenomenon of the wraparound signal.

Output signals of the echo canceller 16 (a reception signal from another device) are respectively output to the D/A converters 18A~18D, and are converted into analog sound signals. The analog sound signals are amplified by the amplifiers 19A~19D and are emitted by the speakers 11A~11D.

Figure 6:
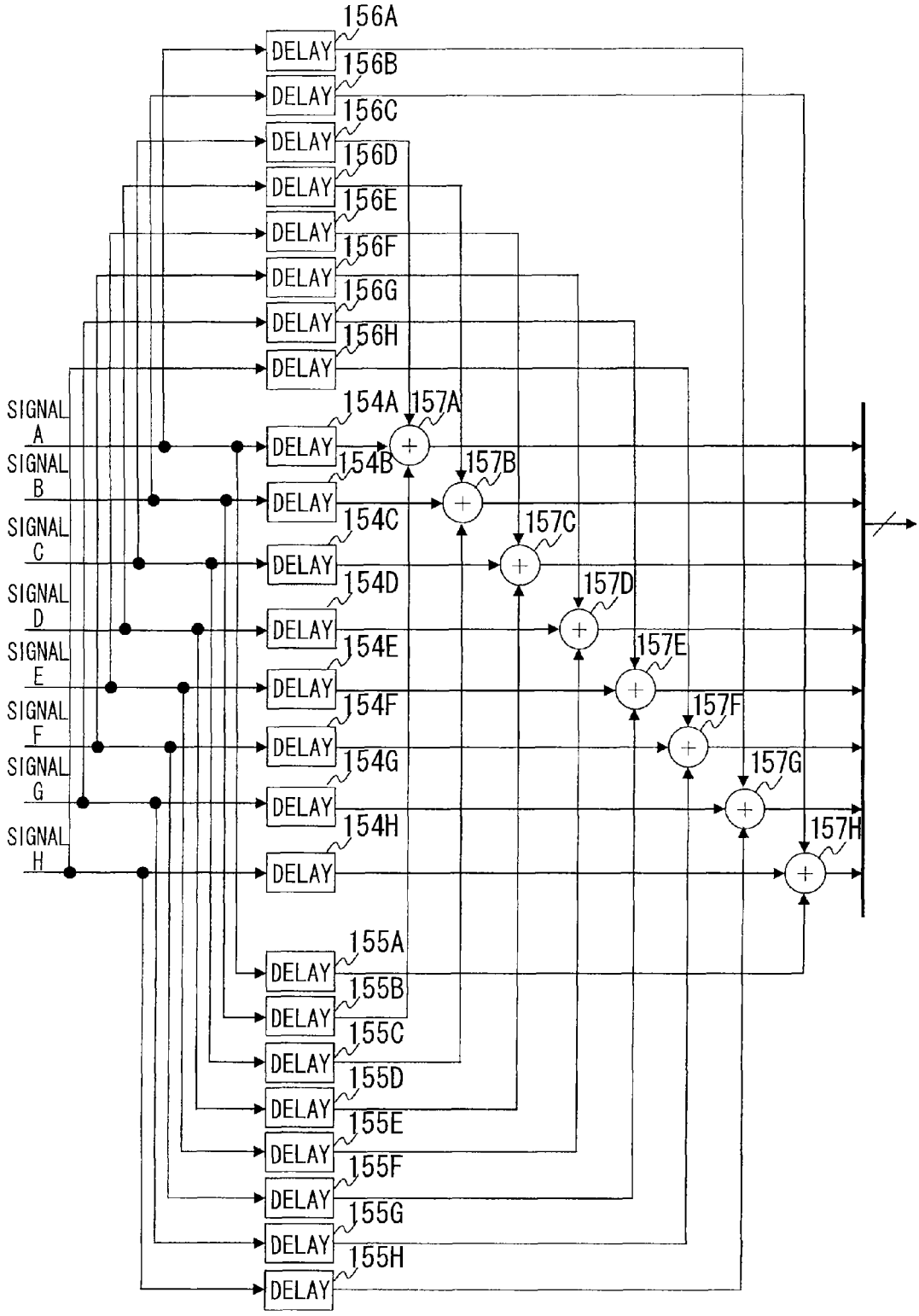
FIG. 6 is a detailed block diagram in an application example of a microphone signal processing circuit.

The configuration of the microphone signal processing circuit 15 is not limited to the above-mentioned example. FIG. 6 shows a configuration of an application example of the microphone signal processing circuit 15. In this example, signals A~H are respectively input to delays 154A~154H, delays 155A~155H, and delays 156A~156H. Output signals of the delays 154A~154H are respectively input to the adders 157A~157H. Output signals of the delays 155A~155H are shifted to adjacent adders 157 and are input to the adders 157A~157H. That is, each adder 157 adds an output signal of a corresponding microphone 12 and an output signal of an adjacent microphone 12 in such a way that an output signal of the delay 155B is toward the adder 157A, an output signal of the delay 155C is toward the adder 157B, and an output signal of the delay 155D is toward the adder 157C.

Output signals of the delays 156A~156H are further shifted by one step and are input to the adders 157A~157H. That is, each adder 157 adds an output signal of a corresponding microphone 12 and output signals of both adjacent microphones 12 in such a way that an output signal of the delay 156C is toward the adder 157A, an output signal of the delay 156D is toward the adder 157B, and an output signal of the delay 156E is toward the adder 157C.

The delays 154, 155, 156 apply delay times to input sound signals such that three signals added to the adder 157 have the same phase. For sounds collected by the microphones 12, collected sound signals of two adjacent microphones 12 are respectively added in the same phase in each corresponding adder 157. Since the addition is done in the same phase, a specific direction signal can be enhanced, such that the S/N ratio is improved and the directivity is improved. Of course, the number of signals to be added is not limited to three as above, and a larger number of signals can be added or subtracted, such that the S/N ratio of a predetermined direction can be improved.

Moreover, the structure of the sound emission and collection device of the present invention, the number of speakers 11, and the number of microphones 12 are not limited to examples shown in FIG. 1 and FIG. 2A.

Modified Example of Case 1

Figure 2B:
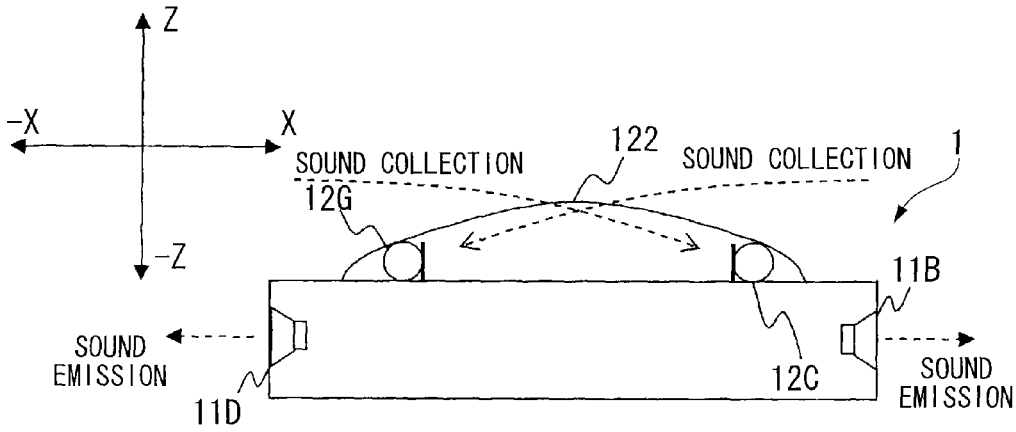
FIG. 2B is an A-A cross-sectional view of a modified example of a case 1.

For example, as shown in FIG. 2B, a dome (hemisphere)-shaped cover 122 having a bulge in the Z direction can be attached on an upper surface of the case 1. The cover 122 has a size for covering all the plurality of microphones 12 installed on the upper surface of the case 1. This cover 122 is made of a steel plate of a punch mesh shape and is configured such that the sound collection of the microphone 12 installed on the upper surface of the case 1 is not obstructed.

Also in a state shown in FIG. 2B, the sound emission direction and the sound collection direction of the speaker 11 and the microphone 12 adjacent to each other (for example, the speaker 11B and the microphone 12C) are substantially opposite directions. Moreover, the speaker 11 and the microphone 12 (for example, the speaker 11B and the microphone 12G) in which the sound emission and collection directions are the same direction are arranged at positions farthest from each other in the case 1. Therefore, also in an example of FIG. 2B, a wraparound sound from the speaker 11 to the microphone 12 is minimized and an S/N ratio is improved.

Embodiment 1

Figure 7A:
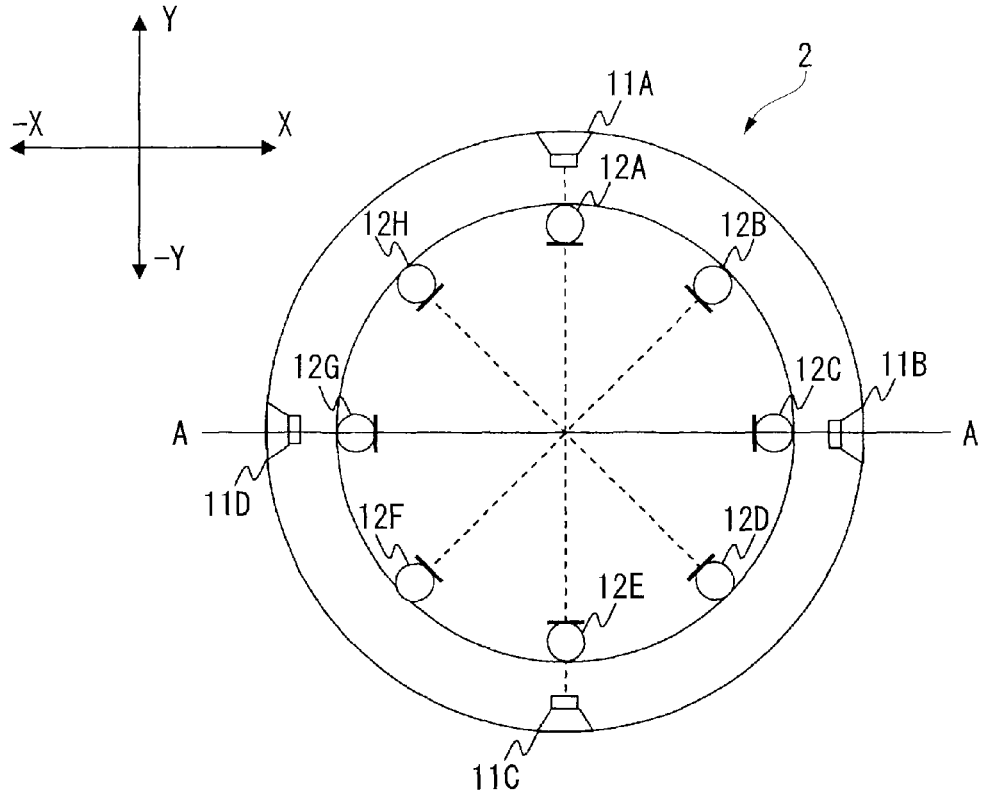
FIG. 7A is a top view of a sound emission and collection device in embodiment 1.
Figure 7B:
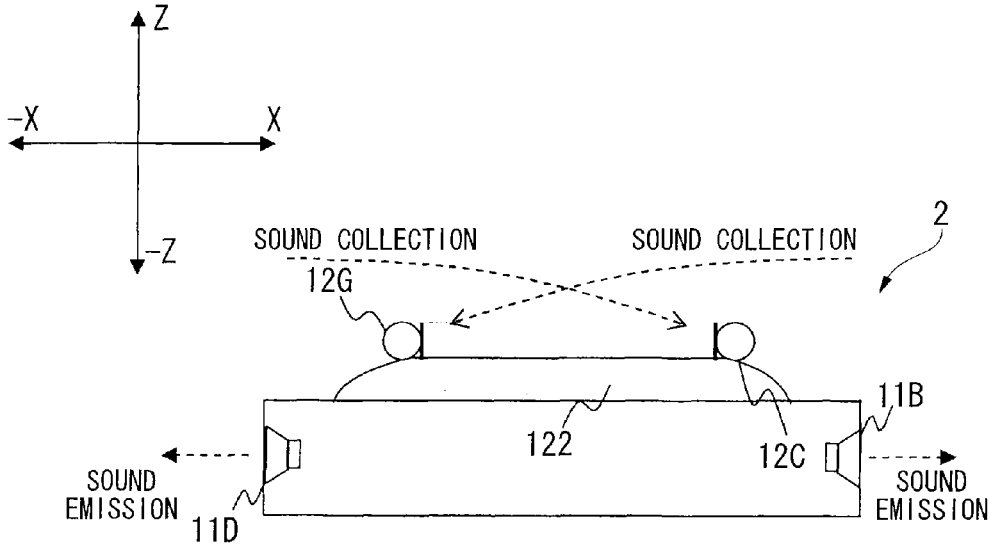
FIG. 7B is an A-A cross-sectional view of the sound emission and collection device in embodiment 1.

FIG. 7 shows a structure of a sound emission and collection device in another example. FIG. 7 is a top view and a cross-sectional view showing the sound emission and collection device of another example. FIG. 7A is the top view of the sound emission and collection device, and FIG. 7B is the A-A cross-sectional view in FIG. 7A of the same. In FIG. 7A, the right side on the paper surface is the X direction, the left side is the −X direction, the upper side is the Y direction, and the lower side is the −Y direction. In FIG. 7B, the right side on the paper surface is the X direction, the left side is the −X direction, the upper side is the Z direction, and the lower side is the −Z direction. Components common with those of the sound emission and collection device shown in FIG. 1 and FIG. 2 are assigned the same reference numerals and signs, and a description thereof is omitted.

In this example, the sound emission and collection device includes a circular cylindrical shaped case 2, a plurality of (in this example, four) speakers 11A~11D arranged at equal intervals on a concentric circle on an outermost circumference portion of the case 2, and a plurality of (in this example, eight) microphones 12A~12H arranged at equal intervals on a concentric circle on the upper surface of the case 2.

The case 2 has a compact circular cylindrical shape in which a diameter of a cross-sectional circle when viewed from the upper surface is about 30 cm, and has a height of a level (for example, about 10 cm) at which a sound emission surface of a speaker 11 can be arranged on a circular cylindrical side surface. The case 2 has a trapezoid shaped bulge in the Z direction in the vicinity of the center of the upper surface. The microphone 12 is installed on the upper portion of the bulge surface. In the bulge surface, a center portion is formed with a flat surface such that the sound collection of the microphone 12 is not obstructed.

Each speaker 11 is installed such that a sound emission direction is outside the case 2. Each microphone 12 is installed such that the sound collection direction is a center direction (for example, the sound collection direction of the microphone 12C is the −X direction and the sound collection direction of the microphone 12G is the X direction) when viewed from the upper surface of the case 2. Since each microphone 12 is mounted and installed on the upper surface of the case 2, a sound inside the case 2 (an emitted sound of the speaker 11 within the case 2) is not collected.

Each speaker 11 and each microphone 12 are installed with different heights, but the sound emission direction and the sound collection direction of the speaker 11 and the microphone 12 adjacent to each other (for example, the speaker 11B and the microphone 12C) are substantially opposite directions. The speaker 11 and the microphone 12 (for example, the speaker 11B and the microphone 12G) of which the sound emission and collection directions are the same direction are arranged at positions farthest from each other in the case 2. Therefore, also in this example, a wraparound sound from the speaker 11 to the microphone 12 is minimized and an S/N ratio is further improved in comparison with that of a general sound emission and collection device (for example, when the sound emission surface of the speaker is the upper side and the sound collection surface of the microphone is the outside).

Embodiment 2

Figure 8A:
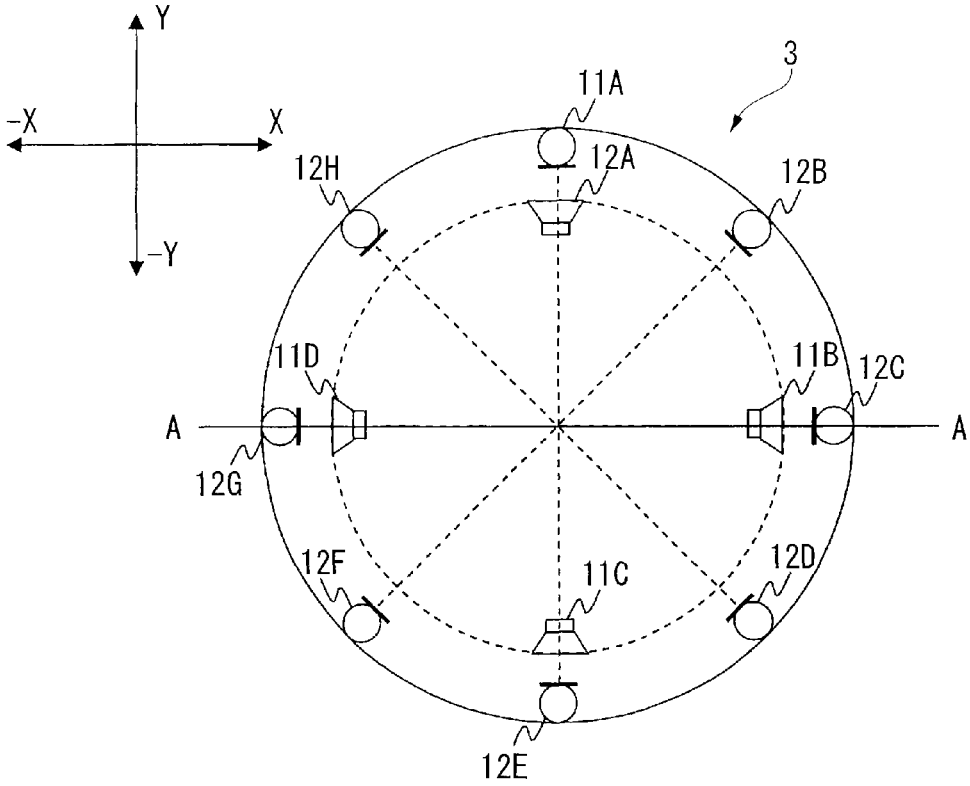
FIG. 8A is a top view of a sound emission and collection device in embodiment 2.
Figure 8B:
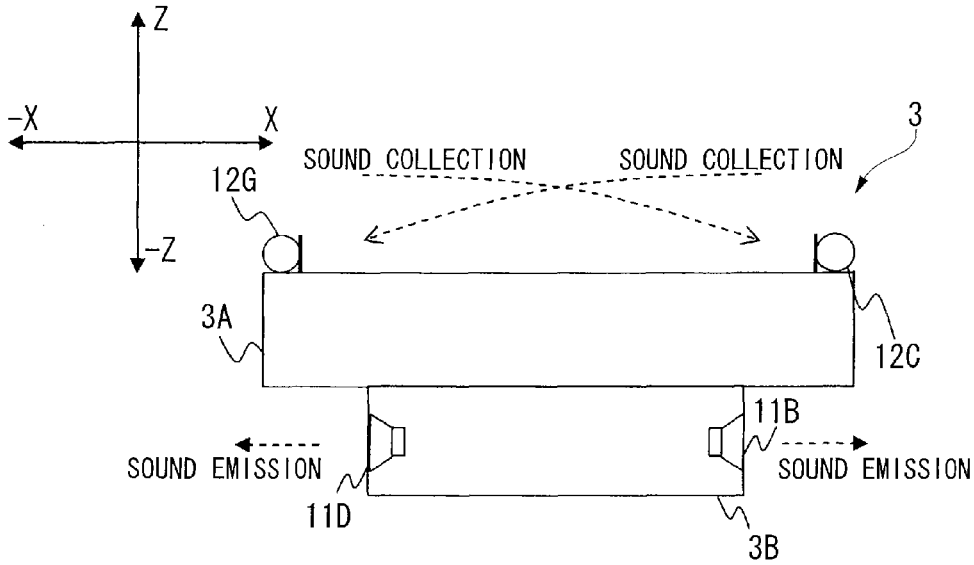
FIG. 8B is an A-A cross-sectional view of the sound emission and collection device in embodiment 2.

Moreover, a sound emission and collection device can have a structure as shown in FIG. 8. FIG. 8 is a top view and a cross-sectional view showing the sound emission and collection device of another example. FIG. 8A is the top view of the sound emission and collection device, and FIG. 8B is the A-A cross-sectional view in FIG. 8A of the same. In FIG. 8A, the right side on the paper surface is the X direction, the left side is the −X direction, the upper side is the Y direction, and the lower side is the −Y direction. In FIG. 8B, the right side on the paper surface is the X direction, the left side is the −X direction, the upper side is the Z direction, and the lower side is the −Z direction. Also in this example, components common with those of the sound emission and collection device shown in FIG. 1 and FIG. 2 are assigned the same reference numerals and signs, and a description thereof is omitted.

In an example of the same figure, the sound emission and collection device includes a case 3 having a structure in which a plurality of circular cylindrical shaped cases (an upper case 3A and a lower case 3B) are overlapped in a vertical direction, and includes a plurality of microphone 12A~microphone 12H arranged at equal intervals on a concentric circle on the upper surface of an outermost circumference portion of the case 3A, and a plurality of speakers 11A~11D arranged at equal intervals on a concentric circle on an outermost circumference portion of the case 3B.

The upper case 3A and the lower case 3B are cemented such that the bottom center is on the same axis, the upper case 3A has a larger volume than the lower case 3B, and the side surface of the upper case 3A is the outer circumference side, and the side surface of the lower case 3B is the inner circumference side, when viewed from the upper surface.

Each speaker 11 is installed such that the sound emission direction is outside the case 2. Each microphone 12 is installed such that the sound collection direction is a center direction (for example, the sound collection direction of the microphone 12C is the −X direction and the sound collection direction of the microphone 12G is the X direction) when viewed from the upper surface of the case 3. Since each microphone 12 is mounted and installed on the upper surface of the case 3, a sound inside the case 3 (an emitted sound of the speaker 11 within the case 3) is not collected.

Also when each speaker 11 is installed on the inner circumference of the concentric circle and each microphone 12 is installed on the outer circumference side, when viewed from the upper side of the case as described above, the sound emission direction and the sound collection direction of the speaker 11 and the microphone 12 adjacent to each other (for example, the speaker 11B and the microphone 12C) are substantially opposite directions. The speaker 11 and the microphone 12 (for example, the speaker 11B and the microphone 12G) of which the sound emission and collection directions are the same direction are arranged at positions farthest from each other in the case 3. Therefore, also in this example of FIG. 8, a wraparound sound from the speaker 11 to the microphone 12 is minimized and an S/N ratio is further improved.

Embodiment 3

Figure 9A:
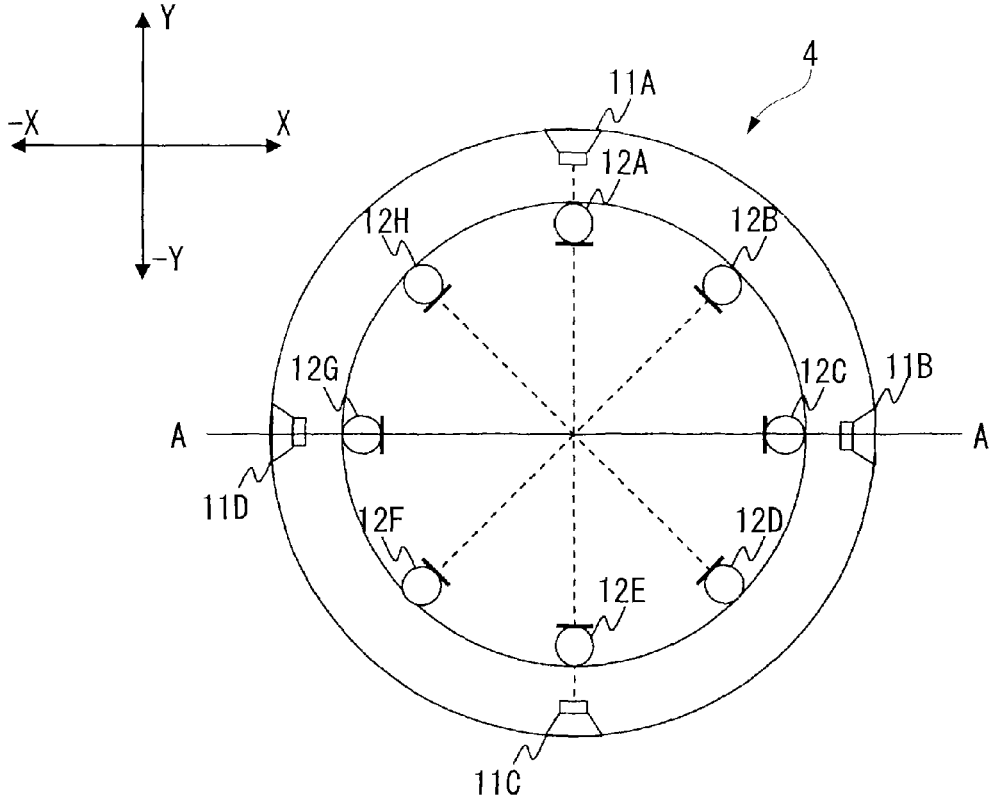
FIG. 9A is a top view of a sound emission and collection device in embodiment 3.
Figure 9B:
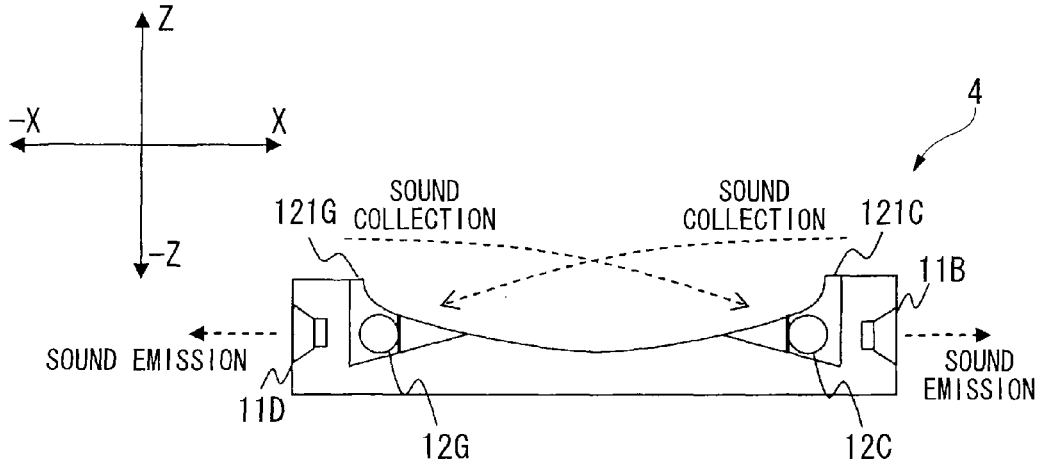
FIG. 9B is an A-A cross-sectional view of the sound emission and collection device in embodiment 3.

FIG. 9 is a top view and a cross-sectional view showing a sound emission and collection device of a further another example. FIG. 9A is the top view of the sound emission and collection device, and FIG. 9B is the A-A cross-sectional view in FIG. 9A of the same. In FIG. 9A, the right side on the paper surface is the X direction, the left side is the −X direction, the upper side is the Y direction, and the lower side is the −Y direction. In FIG. 9B, the right side on the paper surface is the X direction, the left side is the −X direction, the upper side is the Z direction, and the lower side is the −Z direction. Also in this example, components common with those of the sound emission and collection device shown in FIG. 1 and FIG. 2 are assigned the same reference numerals and signs, and a description thereof is omitted.

In this example, the sound emission and collection device includes a substantially circular cylindrical shaped case 4, a plurality of (in this example, four) speakers 11A~11D arranged at equal intervals on a concentric circle on an outermost circumference portion of the case 4, and a plurality of (in this example, eight) microphones 12A~12H arranged at equal intervals on a concentric circle inside the case 1.

The case 4 has a compact circular cylindrical shape in which a diameter of a cross-sectional circle when viewed from the upper surface is about 30 cm, and has a height level (for example, about 10 cm) at which a sound emission surface of a speaker 11 can be arranged on a circular cylindrical side surface.

Each speaker 11 is installed on each side surface such that the sound emission direction is outside the case 4. Each microphone 12 is installed such that the sound collection direction is a center direction (for example, the sound collection direction of the microphone 12C is the −X direction and the sound collection direction of the microphone 12G is the X direction) when viewed from the upper surface of the case 4. The case 4 is concaved in a hemisphere shape around the center of the upper surface in a case inside direction (−Z direction), and a plurality of openings are empty in part of this concave surface. Closed boxes 121A~121H are installed in these openings, and the microphones 12A~12H are respectively embedded inside the boxes 121A~121H. The above-mentioned opening serves as an aperture surface of the box 121 and the sound collection surface of the microphone 12 is toward the aperture surface of the box 121. This box 121 is made of an elastic body of rubber or the like, and intercepts the propagation of a sound emitted from the speaker 11 within the case 4. Since each microphone 12 has the sound collection direction being the center direction of the case 4 but the plurality of microphones 12 are installed to face each other, the respective microphones 12 can collect sounds of all the circumferential directions (eight directions) of the sound emission and collection device.

Each speaker 11 and each microphone 12 are installed with the substantially same height. Therefore, the sound emission direction and the sound collection direction of the speaker 11 and the microphone 12 adjacent to each other (for example, the speaker 11B and the microphone 12C) are opposite directions. The speaker 11 and the microphone 12 (for example, the speaker 11B and the microphone 12G) of which the sound emission and collection directions are the same direction are arranged at positions farthest from each other in the case 4. Therefore, a wraparound sound from the speaker 11 to the microphone 12 is minimized and an S/N ratio is further improved in comparison with that of a general sound emission and collection device (for example, when the sound emission surface of the speaker is the upper side of the case and the sound collection surface of the microphone is the outside of the case).

Embodiment 4

Figure 10A:
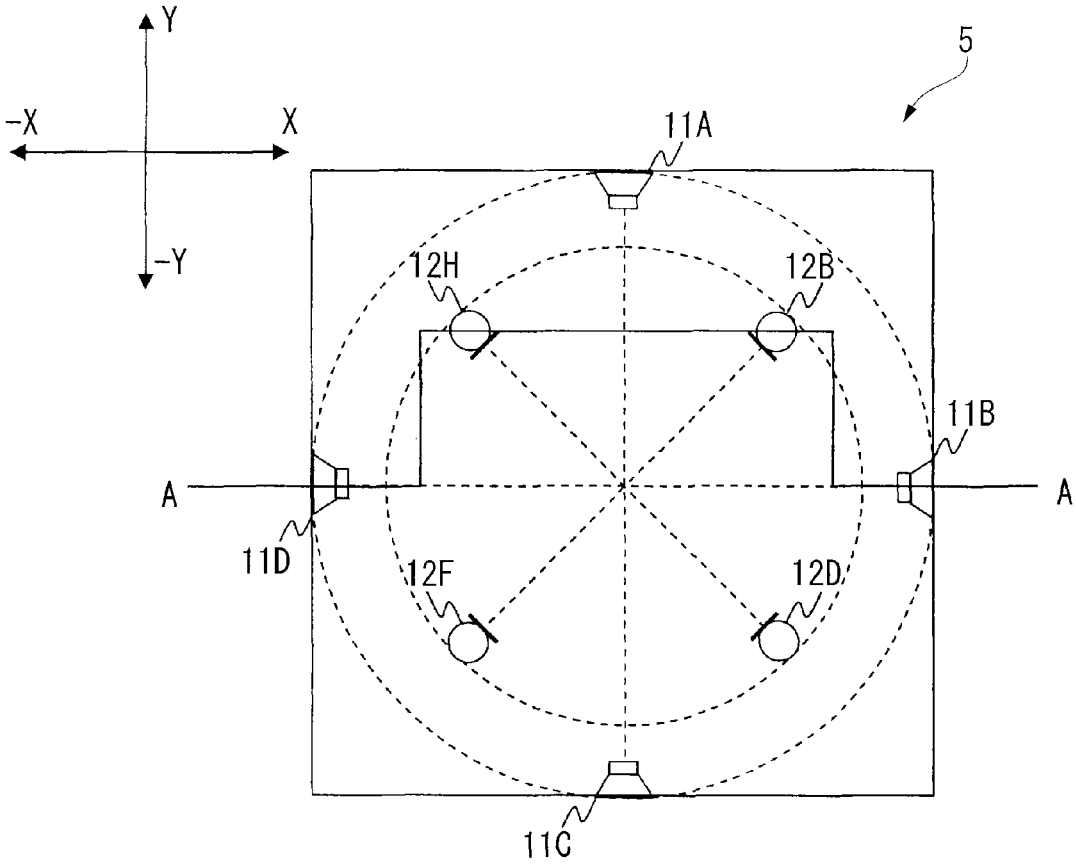
FIG. 10A is a top view and an A-A cross-sectional view of a sound emission and collection device in embodiment 4.
Figure 10B:
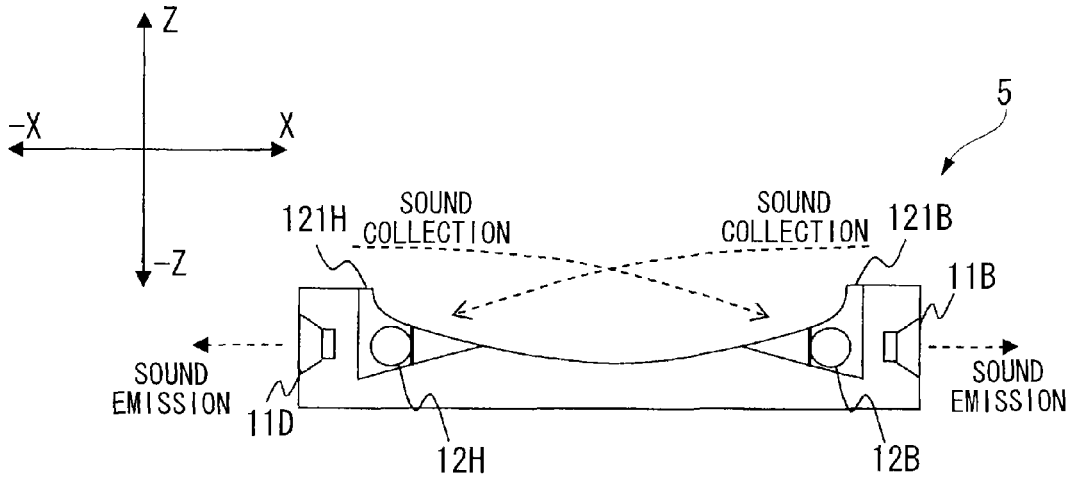
FIG. 10B is an A-A cross-sectional view of the sound emission and collection device in embodiment 4.

FIG. 10 is a top view and a cross-sectional view showing a sound emission and collection device of a further another example. FIG. 10A is the top view of the sound emission and collection device, and FIG. 10B is the A-A cross-sectional view in FIG. 10A of the same. In FIG. 10A, the right side on the paper surface is the X direction, the left side is the −X direction, the upper side is the Y direction, and the lower side is the −Y direction. In FIG. 10B, the right side on the paper surface is the X direction, the left side is the −X direction, the upper side is the Z direction, and the lower side is the −Z direction. Also in this example, components common with those of the sound emission and collection device shown in FIG. 1 and FIG. 2 are assigned the same reference numerals and signs, and a description thereof is omitted.

In this example, the sound emission and collection device includes a substantially rectangular parallelepiped-shaped case 5, a speaker 11A installed on a Y side surface of the case 5, a speaker 11B installed on an X side surface, a speaker 11C installed on a −Y side surface, and a speaker 11D installed on an −X side surface. There are provided a microphone 12B installed in a direction of X, Y 45 degrees, a microphone 12D installed in a direction of X, −Y 45 degrees, a microphone 12F installed in a direction of X, −Y 45 degrees, a microphone 12H installed in a direction of −X, Y 45 degrees inside the case 5.

The case 5 has a cross-sectional shape of a square shape in which a length of one side when viewed from the upper surface is about 30 cm, and has a height of a level (for example, about 10 cm) at which a sound emission surface of a speaker 11 can be arranged on a rectangular parallelepiped side surface.

Each speaker 11 is installed on each side surface such that the sound emission direction is outside the case 5. Each microphone 12 is installed such that the sound collection direction is the center direction when viewed from the upper surface of the case 5 (for example, the sound collection direction of the microphone 12B is a direction of −X, −Y 45 degrees and the sound collection direction of the microphone 12H is a direction of X, −Y 45 degrees). The case 5 is concaved in a hemisphere shape around the center of the upper surface in a case inside direction (−Z direction), part of this concave surface is exposed on an inner side (in a punch mesh, or the like), and the sound collection surface of the microphone 12 is configured to be seen. The microphones 12B~12H are respectively fitted in closed boxes 121B~121H installed inside the case of the exposed surface. This box 121 is made of an elastic body of rubber or the like, and intercepts the propagation of a sound emitted from the speaker 11 within the case 5.

Also in the sound emission and collection device in this example, the microphones 12B~12H can be installed on the upper surface of the case 5 and a hemispherical cover can be attached as shown in FIG. 2B.

Figure 11:
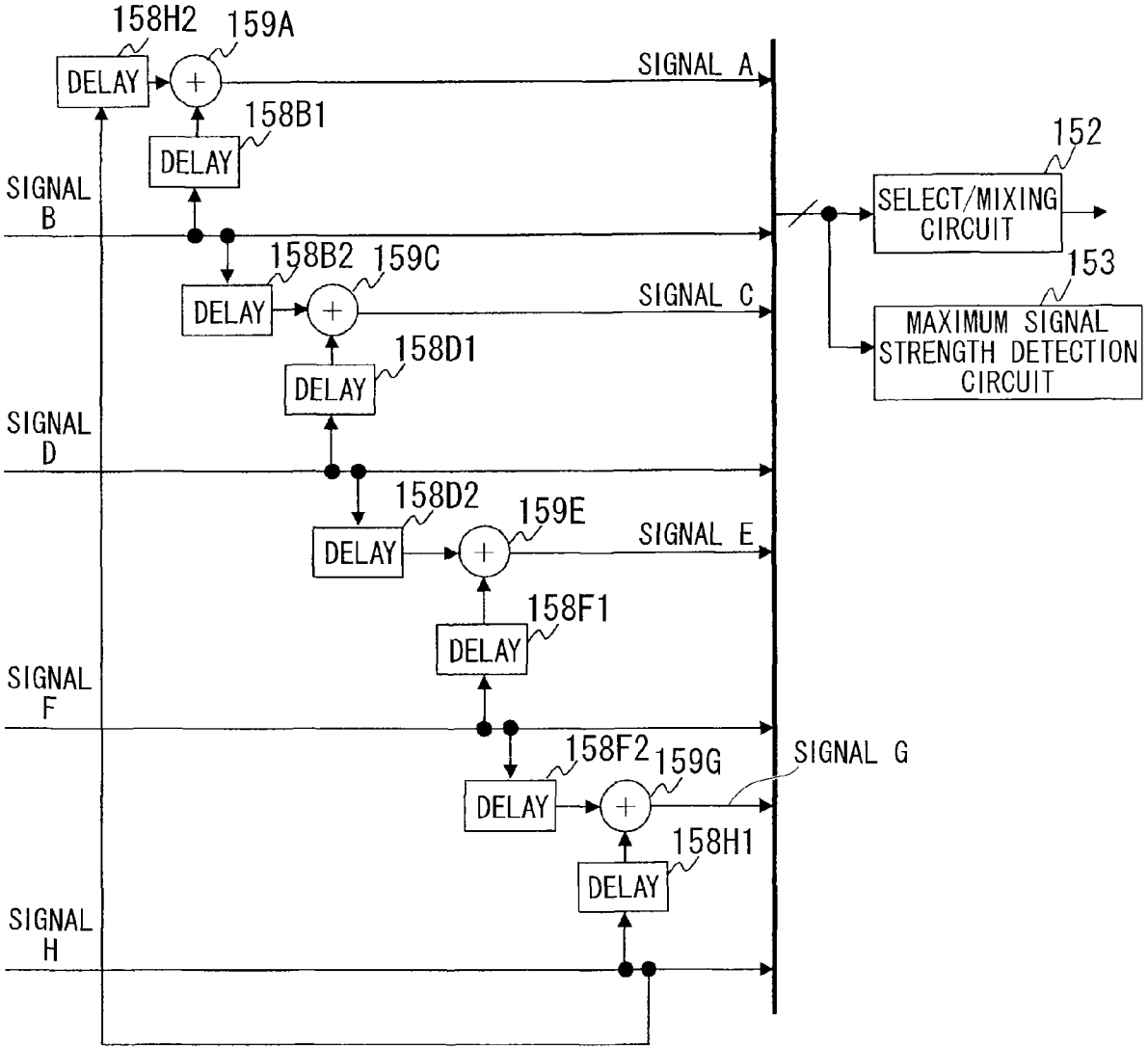
FIG. 11 is a block diagram of a microphone signal processing circuit.

As described above, the shape of the case is not limited to a circular cylinder, and can be a rectangular parallelepiped shape. Moreover, the number of microphones and the number of speakers are not limited to the above-mentioned example. In the sound emission and collection device shown in FIG. 10, an example in which the number of microphones is four has been described, but a larger number of microphones can be virtually installed. FIG. 11 is a block diagram showing a configuration of the microphone signal processing circuit 15 of the sound emission and collection device in FIG. 10. Signals B~H output from the microphones 12B~12H are respectively input to the select/mixing circuit 152, but each signal is branched and input to a plurality of delays 158. For example, the signal B is branched and input to a delay 158B1 and a delay 158B2. Similarly, the signal D is branched and input to a delay 158D1 and a delay 158D2, the signal F is branched and input to a delay 158F1 and a delay 158F2, and the signal H is branched and input to a delay 158H1 and a delay 158H2.

Output signals of the delay 158B2 and the delay 158D1 are input to an adder 159C. Similarly, output signals of the delay 158D2 and the delay 158F1 are input to an adder 159E, output signals of the delay 158F2 and the delay 158H1 are input to an adder 159G, and output signals of the delay 158H2 and the delay 158B1 are input to an adder 159A.

Figure 12:
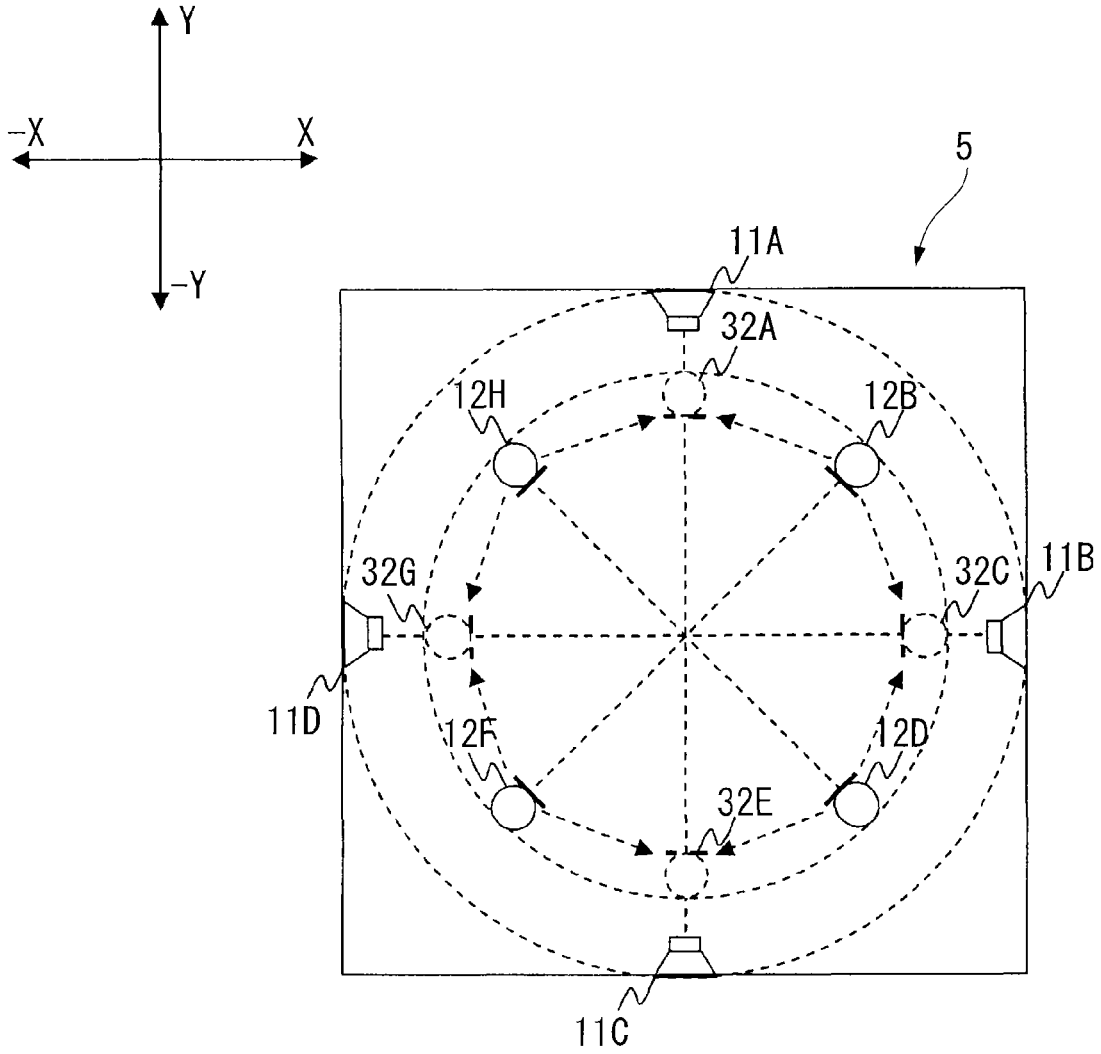
FIG. 12 is a view showing a concept of a virtual microphone.

Since two signals of adjacent microphones 12 are assigned delay times in the delays 158 and are added in the adders 159, output signals of the adders 159 correspond to sounds collected at positions between the microphones 12. For example, when the delay time of the signal B in the delay 158B1 is the same as the delay time of the signal H in the delay 158H2, the signal A output by addition in the adder 159A is the same as the sound collected by the microphone installed at a position at which distances of the microphone 12B and the microphone 12H are identical as shown in FIG. 12. That is, the signal A shown in FIG. 11 indicates an output signal of a virtual microphone 32A. Similarly, the signal C shown in FIG. 11 indicates an output signal of a virtual microphone 32C, the signal E indicates an output signal of a virtual microphone 32E, and the signal G indicates an output signal of a virtual microphone 32G. Therefore, in this example, sounds of eight directions can be collected by four microphones 12.

Second Embodiment

A sound emission and collection device related to an embodiment of the present invention will be described with reference to the drawings.

Figure 13A:
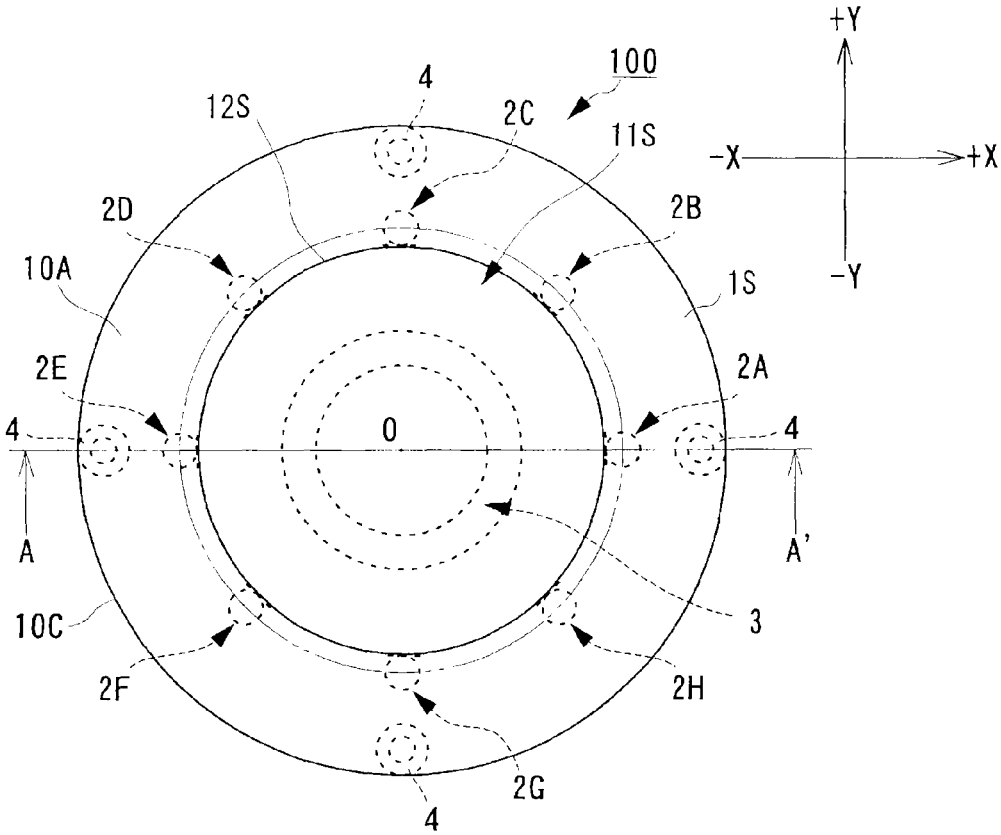
FIG. 13A is a view showing a configuration of main parts of a sound emission and collection device of an embodiment of the present invention.
Figure 13B:
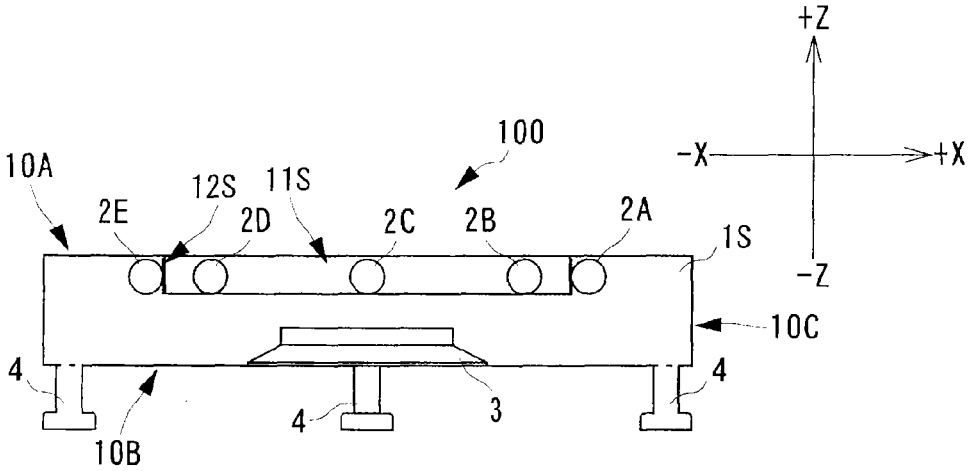
FIG. 13B is an A-A cross-sectional view of a sound emission and collection device of an embodiment of the present invention.

FIGS. 13A and B are views showing a configuration of main parts of a sound emission and collection device 100 of this embodiment, FIG. 13A is a plan view, and FIG. 13B is an A-A' cross-sectional view in FIG. 13A. In FIG. 13A and FIG. 13B, the right side toward the paper surface is the +X direction and the left side toward the paper surface is the −X direction. In FIG. 13A, the upper side toward the paper surface is the +Y direction and the lower side toward the paper surface is the −Y direction. In FIG. 13B, the upper side toward the paper surface is the +Z direction and the lower side toward the paper surface is the −Z direction.

Figure 16:
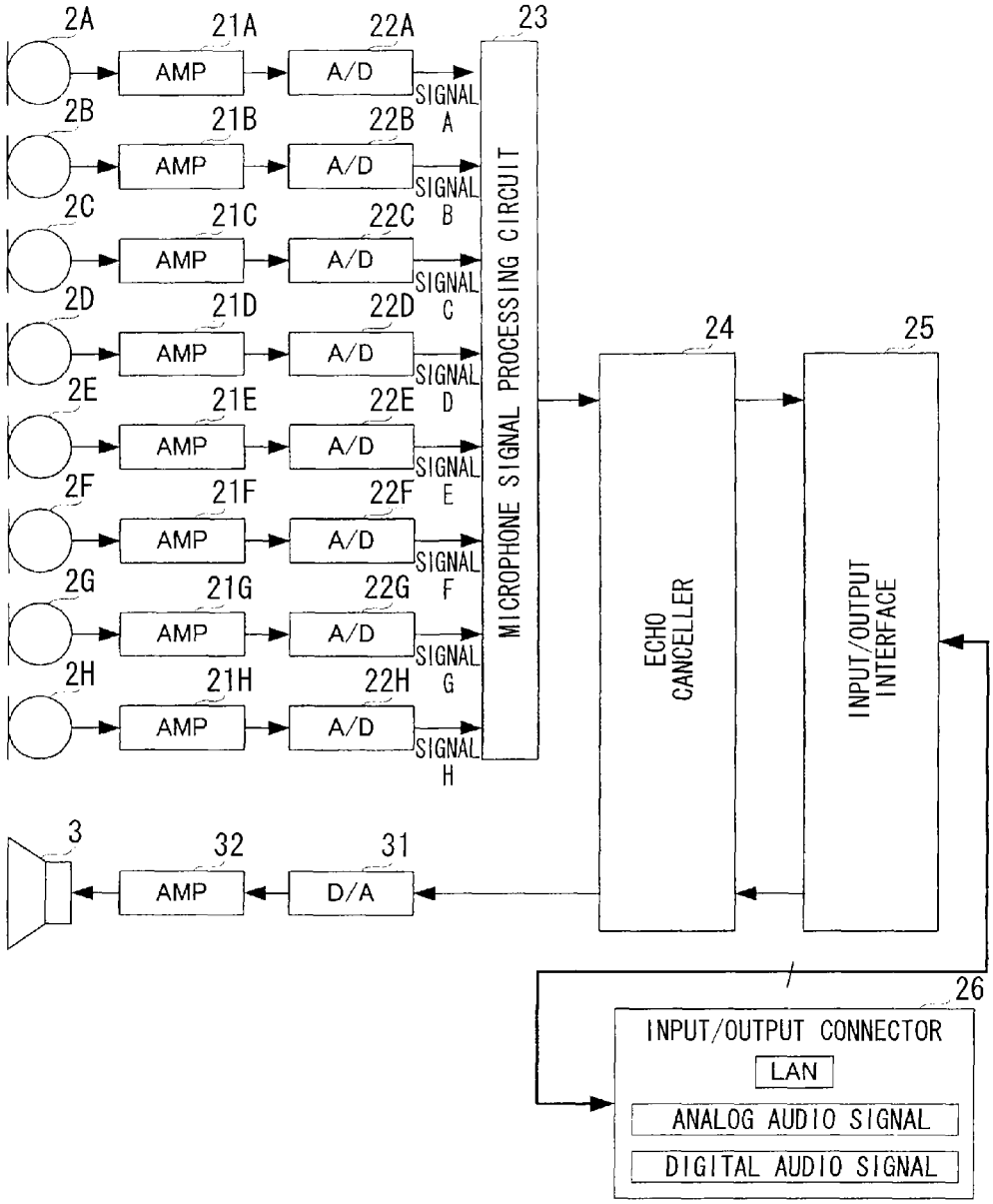
FIG. 16 is a block diagram showing a configuration of a sound emission and collection device of an embodiment of the present invention.

The sound emission and collection device 100 of this embodiment includes a case 15, a plurality of microphones 2A~2H, a speaker 3, and a signal processing function section shown in FIG. 16.

The case 1S has a substantially circular cylindrical shape externally, has a first surface 10A and a second surface 10B of a circular shape of substantially the same size and a flat surface shape, and has a side surface 10C of a circumference surface shape in which this connects to edges of the first surface 10A and the second surface 10B and they are arranged at predetermined intervals. In the vicinity of the edge portion of the second surface 10B, four foot portions 4 arranged at intervals of substantially 90 degrees are installed.

On the first surface 10A of the case 1S, a concave portion 11S in which the plane shape is a circular shape is formed, and the center of the circular shape in the plan view of the first flat surface 10A is the same as the center of the circular shape in the plan view of the concave portion 11S. Hereinafter, the center point is referred to as a "center point O".

Microphones 2A~2H are unidirectional microphones, and are arranged at point-symmetrical positions in which the center point O is a reference point. The microphones 2A~2H are installed to be spaced by a predetermined distance or more from the center point O and are more preferably installed at positions close to an edge portion of the first flat surface 10A.

Specifically, in the microphones 2A~2H as shown in FIG. 13A, the microphone 2A is arranged in the +X direction and the microphone 2E is arranged in the −X direction, along an inner circumference wall surface 12S at the same distance from the center point O in a state in which the center point O is set as the reference point. Similarly, in a state in which the center point O is set as the reference point, the microphone 2B is arranged in a 45-degree direction of the +X direction and the +Y direction and the microphone 2F is arranged in a 45-degree direction of the −X direction and the −Y direction. In a state in which the center point O is set as the reference point, the microphone 2C is arranged in the +Y direction and the microphone 2G is arranged in the −Y direction. In a state in which the center point O is set as the reference point, the microphone 2D is arranged in a 45-degree direction of the −X direction and the +Y direction and the microphone 2H is arranged in a 45-degree direction of the +X direction and the −Y direction.

The microphones 2A~2H are installed such that a direction of directivity is a direction toward the center point O. Thereby, each microphone is set such that a sound collection sensitivity of the center point O direction is higher than that of another direction.

The second surface 10B of the case 1S has the relationship in which the second surface 10B and the sound emission surface are substantially identical, and the speaker 3 is arranged such that the sound emission direction is a direction from the second surface 10B to the outside of the case 1S. The speaker 3 is a non-directional speaker including a cone type speaker unit, a horn type speaker unit, or the like, and the center of the sound emission surface of the speaker 3 is arranged to be placed on a line perpendicular to the first surface 10A through the center point O of the first flat surface 10A.

Although not shown in FIG. 13, the signal processing function section to be described later is installed in an empty space other than arrangement positions of the microphones 2A~2H and the speaker 3 within the case 1S. For example, an input/output connector 26 is installed on a side surface 10C of the case 1S.

Such a sound emission and collection device 100 is arranged and used as shown in FIG. 14.

Figure 14A:
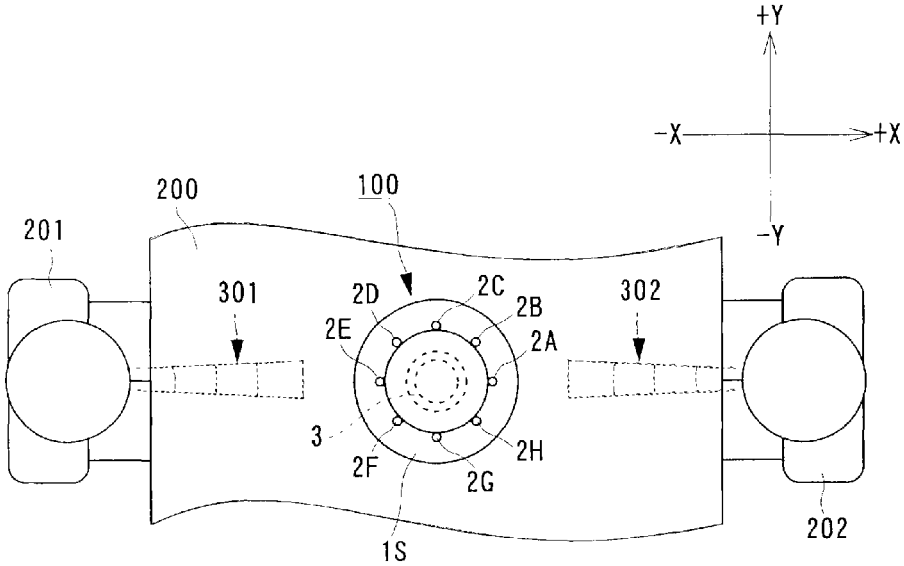
FIG. 14A is a view showing when two users 201, 202 use a sound emission and collection device 100 of an embodiment of the present invention.
Figure 14B:
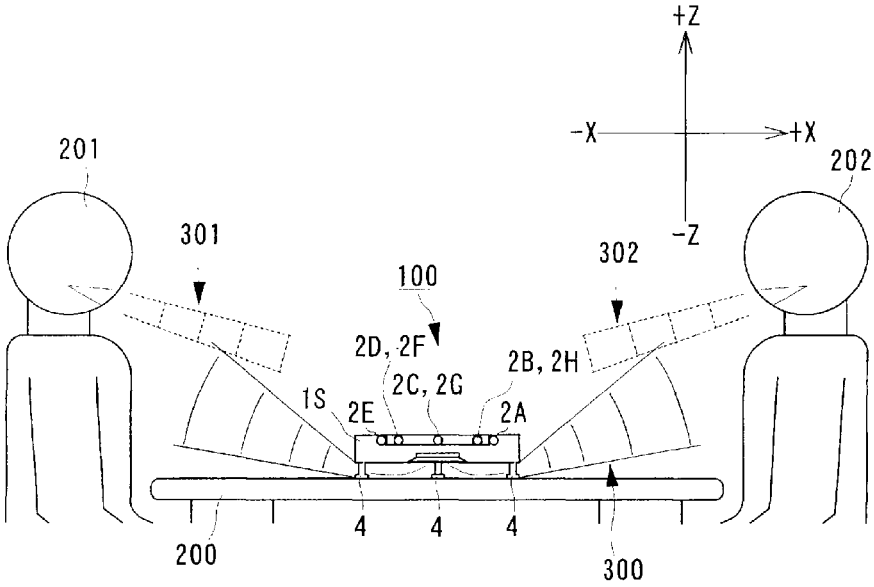
FIG. 14B is a view showing when two users 201, 202 use a sound emission and collection device 100 of an embodiment of the present invention.

FIG. 14 is a view showing when two users 201, 202 use the sound emission and collection device 100 of this embodiment, FIG. 14A is a plan view, and FIG. 14B is a side view. Also in FIG. 14A and FIG. 14B, the right side toward the paper surface is the +X direction and the left side toward the paper surface is the −X direction. In FIG. 14A, the upper side toward the paper surface is the +Y direction and the lower side toward the paper surface is the −Y direction. In FIG. 14B, the upper side toward the paper surface is the +Z direction, and the lower side toward the paper surface is the −Z direction.

The sound emission and collection device 100 is arranged on the top surface at a substantially center position of the top surface of a desk 200. On this occasion, a plurality of foot portions 4 are in contact with the top surface of the desk and are arranged in a state in which the case 1S is separated by a predetermined distance from the top surface.

Although not shown, the sound emission and collection device 100 is connected to a LAN via the above-described input/output connector 26, and is connected to another sound emission and collection device arranged at a distant position, for example, in a place completely different from a room where this device is installed.

At both facing sides between which the sound emission and collection device 100 is arranged on the desk 200, the users 201, 202 stand face to face. In an example of FIG. 14, the user 201 is in the −X direction with respect to the sound emission and collection device 100, and the user 202 is in the +X direction with respect to the sound emission and collection device 100.

(1) Vocalized Sounds from the Users 201, 202

The users 201, 202 vocalize toward the sound emission and collection device 100 when speaking to the other party user present in the room of the other sound emission and collection device.

When the user 201 vocalizes, a vocalized sound 301 thereof arrives at the microphones 2A~2H of the sound emission and collection device 100 while being spread and attenuated. As described above, the microphone 2A has the directivity set to have the high sound collection sensitivity in the center point O direction of the case 1S to the microphone 2A, that is, in the −X direction in which the user 201 is present. For this reason, the microphone 2A is present at a position farthest from the user 201 in comparison with other microphones 2B~2H, but the vocalized sound 301 can be collected at the high sensitivity. On the other hand, the microphone 2E present at a position point-symmetrical with the microphone 2A is present at a position closest to the user 201 in comparison with other microphones 2A~2D, 2F~2H. However, the microphone 2E has the high sound collection sensitivity in the +X direction and collects little of the vocalized sound 301 since the directivity without sound collection sensitivity is set in the −X direction.

When the user 202 vocalizes, a vocalized sound 302 thereof arrives at the microphones 2A~2H of the sound emission and collection device 100 while being spread and attenuated. As described above, the microphone 2E has the directivity set to have the high sound collection sensitivity in the center point O direction of the case 15 to the microphone 2E, that is, in the +X direction in which the user 202 is present. For this reason, the microphone 2E is present at a position farthest from the user 202 in comparison with other microphones 2A~2D, 2F~2H, but the vocalized sound 302 can be collected at the high sensitivity. On the other hand, the microphone 2A present at a position point-symmetrical with the microphone 2E is present at a position closest to the user 202 in comparison with other microphones 2B~2H. However, the microphone 2A has the high sound collection sensitivity in the −X direction and collects little of the vocalized sound 302 since the directivity without sound collection sensitivity is set in the +X direction.

As described above, the vocalized sound of the user is mainly collected in a microphone arranged at a position of an opposite side through the center point O from a side surface at which the user is present.

Figure 15A:
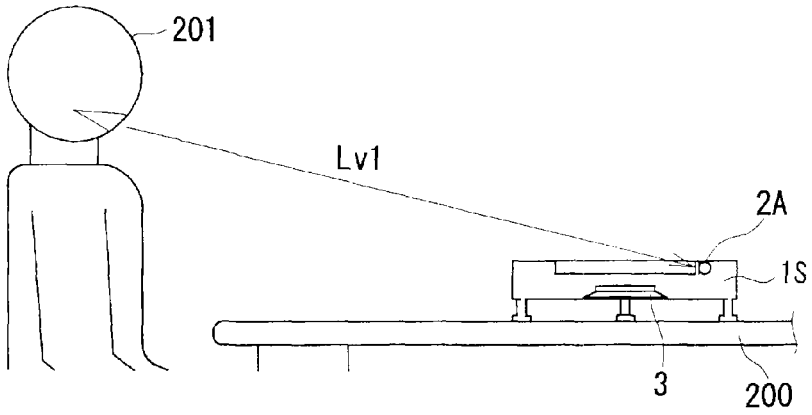
FIG. 15A is a conceptual diagram showing a transfer distance Lv1 of a vocalized sound to a microphone for collecting a main sound in a sound emission and collection device 100 of an embodiment of the present invention.
Figure 15B:
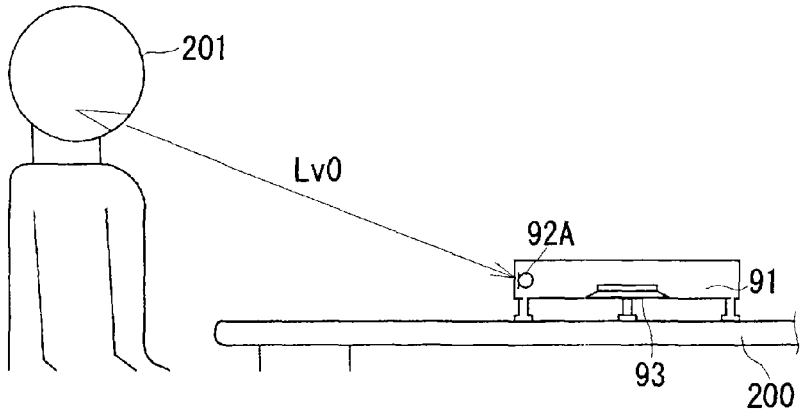
FIG. 15B is a conceptual diagram showing a transfer distance Lv0 of a vocalized sound to a microphone for collecting a main sound in a conventional sound emission and collection device.

By the way, the invention of the above-described Patent Document 2 is a sound emission and collection device in which a speaker is arranged on an upper surface and a microphone is arranged on a side surface, but considers that the speaker 93 is arranged on a lower surface as shown in FIGS. 15B, D to be described later. On this occasion, a microphone 92A arranged on a side surface of a case 91 is set such that the directivity is toward an outside direction of the side surface of the case 91, and collects a vocalized sound of the user 201 closest to the microphone 92A. In the following description, the sound emission and collection device of the configuration shown in FIGS. 15B, D is a representative example of a conventional sound emission and collection device as a comparative target of this embodiment.

FIG. 15A is a conceptual diagram showing a transfer distance Lv1 of a vocalized sound with respect to a microphone for performing main sound collection in the sound emission and collection device 100 of this embodiment, and FIG. 15B is a conceptual diagram showing a transfer distance Lv0 of a vocalized sound with respect to a microphone for performing main sound collection in a sound emission and collection device in which the microphone is arranged on a case side surface. FIG. 15A and FIG. 15B show when the microphone 2A and the microphone 92A respectively collect the vocalized sound of the user 201.

The transfer distance Lv1 of the vocalized sound in the sound emission and collection device in this embodiment shown in FIG. 15A is longer as compared with the transfer distance Lv0 of the vocalized sound in the conventional sound emission and collection device shown in FIG. 15B. However, a difference of a distance from the side surface of the user 201 side to the microphone 2A is very short as compared to a distance from the user 201 to the sound emission and collection device (corresponding to a distance from the user 201 to the microphone 92A), such that an increase of an attenuation amount of the vocalized sound does not need to be considered. Therefore, the sound emission and collection device of this embodiment can collect the vocalized sound at substantially equal to the conventional the sensitivity, that is, the sound pressure level.

(2) Sound from the Other Party of Another Room

The users 201, 202 listen to an output sound from the speaker 3 of the sound emission and collection device 100 when listening to the sound from the other party user present in the room of another sound emission and collection device.

The speaker 3 is arranged on a surface facing the second surface 10B (lower surface) of the case 1S, that is, the top surface of the desk 200, and emits the sound from the other party user. The emitted sound 300 is reflected on the top surface of the desk 200, spread and propagated in a circumference shape in a horizontal direction, and uniformly propagated to a space including the users 201, 202 while being spread from a region of the second surface 10B to the outside including an upward direction. On this occasion, part of the sound 300 is propagated to the first surface 10A side of the case 1S via a side surface 10C of the case 15. Hereinafter, this sound is referred to as the wraparound sound.

As in the above-described vocalized sound, the microphones 2A~2H collect the wraparound sound propagated from an end portion of a direction extending through the center point O, that is, the side surface 10C side of the farthest position, and the microphones 2A~2H collect little of the wraparound sound propagated from the side surface 10C of the closest position. That is, the wraparound sound of the longest propagation path is collected.

Figure 15C:
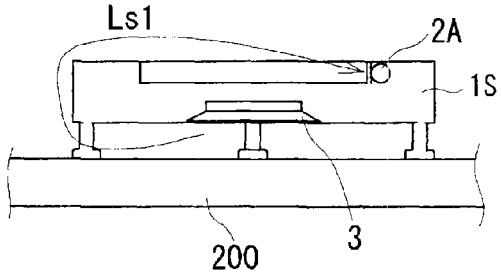
FIG. 15C is a conceptual diagram showing a transfer distance Ls1 of a wraparound sound to a microphone.
Figure 15D:
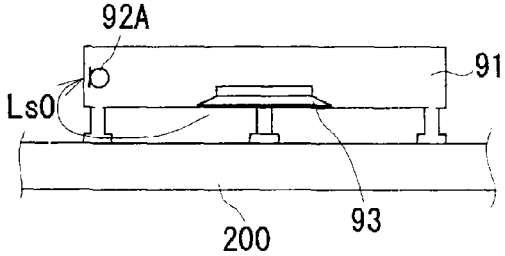
FIG. 15D is a conceptual diagram showing a transfer distance Ls0 of a wraparound sound to a microphone in a conventional sound emission and collection device in which a speaker is arranged on a case side surface.

FIG. 15C is a conceptual diagram showing a transfer distance Ls1 of a wraparound sound to the microphone in the sound emission and collection device 100 of this embodiment, and FIG. 15D is a conceptual diagram showing a transfer distance Ls0 of a wraparound sound to the microphone in the conventional sound emission and collection device having the same configuration as that of FIG. 15B.

The transfer distance Ls1 of the wraparound sound of this embodiment shown in FIG. 15C is longer than the conventional transfer distance Ls0 of the wraparound sound shown in FIG. 15D. This is because the conventional transfer distance Ls0 is substantially equal to the length from the speaker 93 to the side surface 10C on which the microphone 92A for which the outside of the case 91 is in a directivity direction is installed. On the other hand, the transfer distance Ls1 of this embodiment is the same as a total distance of the length from about the speaker 3 to the side surface 10C, the height of the side surface 10C, and the length from the side surface 10C position to the microphone 2A arranged farthest from the position. Thereby, the transfer distance Ls1 of the wraparound sound of this embodiment is at least twice as long as the conventional transfer distance Ls0. As a result, the sound emission and collection device of this embodiment can significantly reduce a collected wraparound sound as compared with the conventional sound emission and collection device.

Only a 90-degree propagation direction from the second surface 10B to the side surface 10C is conventionally varied, but a 90-degree propagation direction from the side surface 10C to the first surface 10A is further varied in the configuration of the embodiment. That is, the 90-degree variation of the propagation direction in this embodiment is one more than that in the conventional technique. Here, this propagation direction variation of a wraparound sound is that naturally wrapped around without a forcible variation by reflection on a wall surface of a reflection wall or the like present at the end of the propagation direction, thereby achieving the significant attenuation according to the number of variations. Therefore, the sound emission and collection device of this embodiment can significantly attenuate a wraparound sound as compared to the conventional sound emission and collection device.

By using the configuration of this embodiment as described above, a vocalized sound from the user being a necessary sound can be collected with high sensitivity, and a wraparound sound from the speaker to the microphone can be significantly attenuated while maintaining the case in a small size. Thereby, a high S/N ratio can be realized.

Next, the signal processing function section for processing a collected sound signal as described above will be described.

FIG. 16 is a block diagram showing the configuration of the sound emission and collection device of this embodiment.

The sound emission and collection device of this embodiment includes the above-described input/output connector 26 as well as the microphones 2A~2H and the speaker 3 as described above, and further includes input amplifiers 21A~21H, A/D converters 22A~22H, a microphone signal processing circuit 23, an echo canceller 24, an input/output interface 25, a D/A converter 31, and an output amplifier 32 as a signal processing function section.

The input/output interface 25 provides the D/A converter 31 with an input sound signal input from the input/output connector 26 via the echo canceller 24. The D/A converter 31 analog-converts an input sound signal to output it to the output amplifier 32, and the output amplifier 32 amplifies the input sound signal to output it to the speaker 3. The speaker 3 converts the input sound signal into a sound to emit the sound.

The microphones 2A~2H collect sounds from the outside, convert them into collected sound signals, and output the collected sound signals to the input amplifiers 21A~21H. The input amplifiers 21A~21H amplify the collected sound signals and output them to the A/D converters 22A~22H. The A/D converters 22A~22H digital-convert the collected sound signals and output them to the microphone signal processing circuit 23. The sound signals collected by the microphones 2A~2H and output from the A/D converters 22A~22H are only referred to as a signal A signal H.

Figure 17:
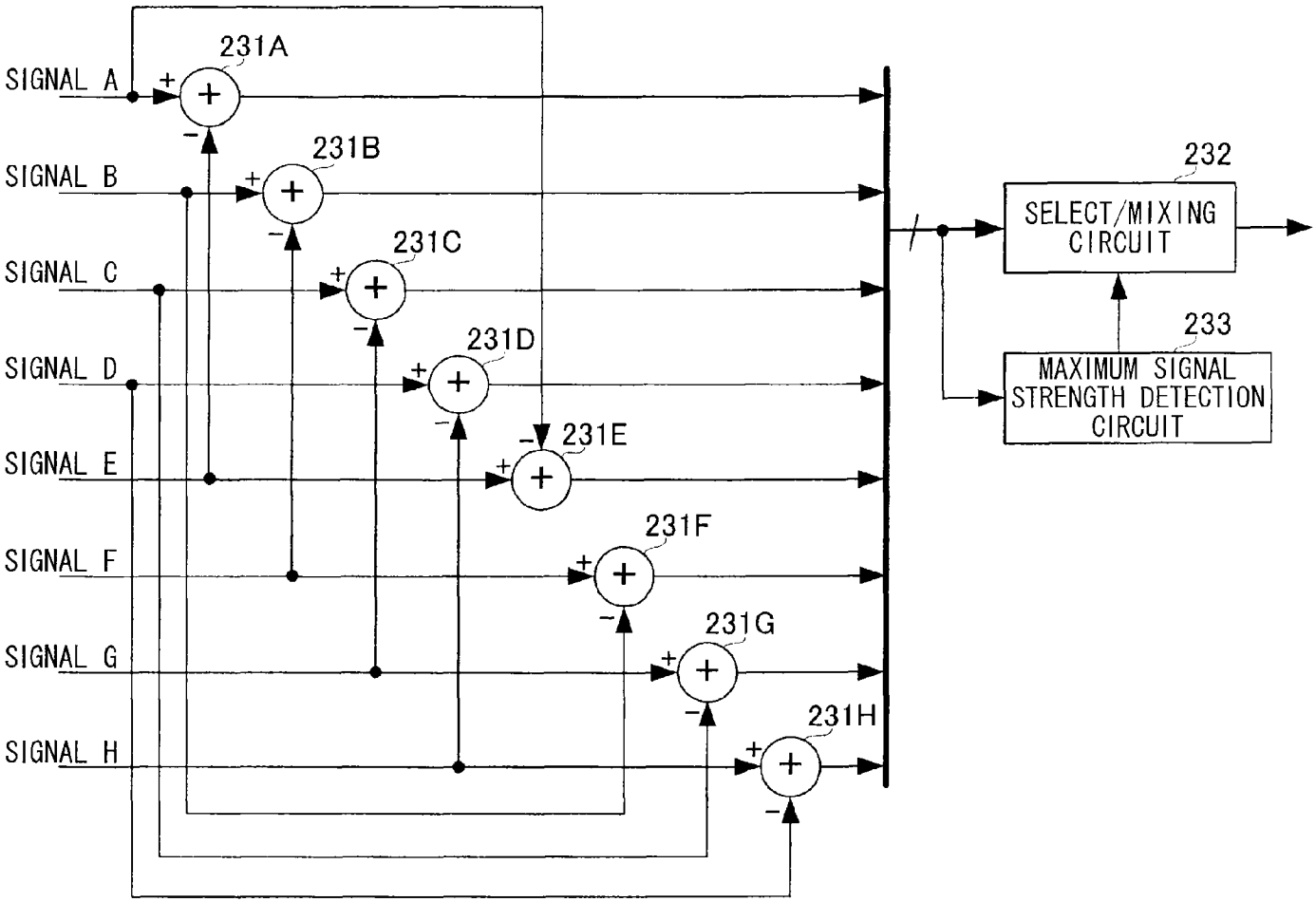
FIG. 17 is a detailed block diagram of a microphone signal processing circuit 23.

FIG. 17 is a detailed block diagram of the microphone signal processing circuit 23.

The microphone signal processing circuit 23 includes adders (subtractors) 231A~231H, a select/mixing circuit 232, and a maximum signal strength detection circuit 233.

The signal A output from the A/D converter 22A and the signal E output from the A/D converter 22E are input to the adder 231A. The adder 231A outputs a corrected signal A by subtracting the signal E from the signal A. Here, the signal A is a sound signal collected by the microphone 2A, and the signal E is a sound signal collected by the microphone E. Since the microphone 2A and the microphone 2E as described above are arranged at positions point-symmetrical with reference to the center point O, the collected wraparound sounds are substantially identical. Thereby, a wraparound sound component can be reduced by subtracting the signal E from the signal A.

Similarly, a corrected signal B is generated by subtracting the signal F from the signal B in the adder 231B, a corrected signal C is generated by subtracting the signal G from the signal C in the adder 231C, and a corrected signal D is generated by subtracting the signal H from the signal D in the adder 231D.

The signal E output from the A/D converter 22E and the signal A output from the A/D converter 22A are input to the adder 231E. The adder 231E outputs a corrected signal E by subtracting the signal A from the signal E. Similarly, a corrected signal F is generated by subtracting the signal B from the signal F in the adder 231F, a corrected signal G is generated by subtracting the signal C from the signal G in the adder 231G, and a corrected signal H is generated by subtracting the signal D from the signal H in the adder 231H.

Thereby, the corrected signals A~H can respectively reduce wraparound sound components.

The generated corrected signals A~H are input to the select/mixing circuit 232 and the maximum signal strength detection circuit 233. The maximum signal strength detection circuit 233 compares the signal strengths of the corrected signals A~H, that is, the sound pressure levels, selects a corrected signal of the highest signal strength, and provides the select/mixing circuit 232 with information for selecting the corrected signal of the highest signal strength. The select/mixing circuit 232 selects a corresponding corrected signal from the input corrected signals A~H on the basis of the selection information provided from the maximum signal strength detection circuit 233, and outputs it to the echo canceller 24. The maximum signal strength detection circuit 233 can detect the corrected signal of the highest signal strength, select the corrected signal of the maximum signal strength and a plurality of corrected signals neighboring to the corrected signal, and provide the select/mixing circuit 232 with them. In view of a plurality of sound sources in different directions, a plurality of corrected signals can be selected in sequence from the corrected signal of the highest signal strength and can be provided to the select/mixing circuit 232. In these cases, the select/mixing circuit 232 selects and mixes a corresponding plurality of corrected signals based on selection information and makes an output to the echo canceller 24.

By performing such a selection process, an S/N ratio can be further improved by deleting a corrected signal of a low signal strength that is difficult to be considered as a vocalized sound from the user.

Figure 18:
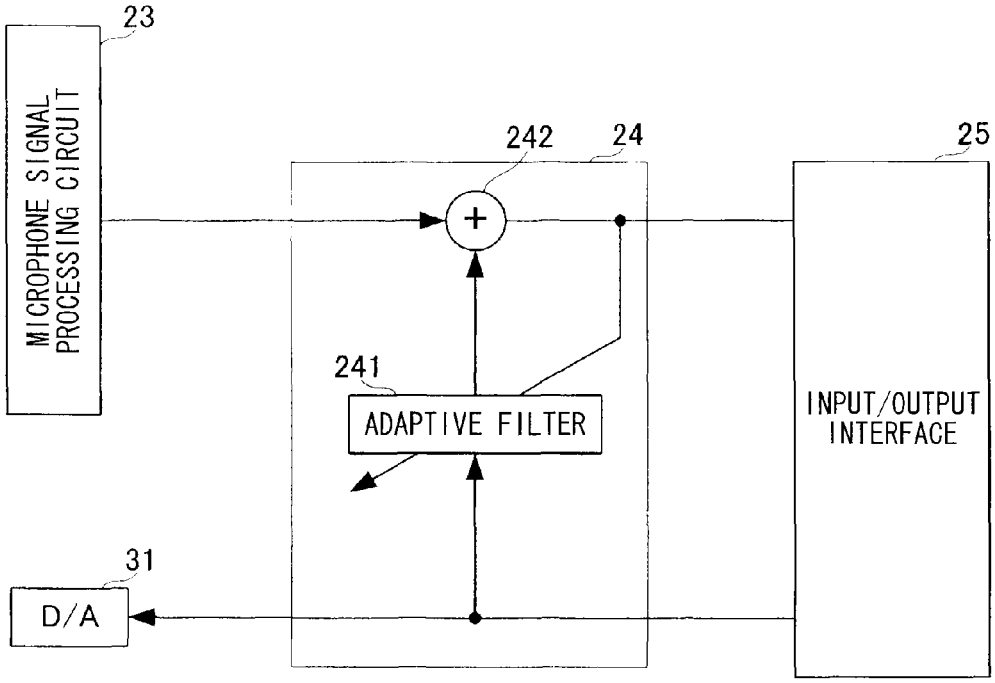
FIG. 18 is a detailed block diagram of an echo canceller 24.

FIG. 18 is a detailed block diagram of the echo canceller 24.

The echo canceller 24 has an adaptive filter 241 and an adder 242. The adaptive filter 241 includes a digital filter of an FIR filter or the like, and computes a filter factor of the FIR filter such that a transfer function of an acoustic propagation path from the speaker 3 to the microphones 2A~2H is estimated and the estimated transfer function is simulated. The adaptive filter 241 generates a pseudo echo sound signal using the estimated filter factor and outputs it to the adder 242. The adder 242 subtracts the pseudo echo sound signal from the output signal of the microphone signal processing circuit 23 and outputs an output sound signal to the input/output interface 25. Here, the estimation of the transfer function and the computation of the filter factor are repeatedly performed by feeding back a residual signal being a signal output from the adder 242 as a reference signal to the adaptive filter 241 and using an adaptive algorithm based on an input sound signal to be supplied to the speaker 3. Thereby, the estimation of the transfer function and the setting of the filter factor are optimized.

By performing such a process, a wraparound sound component is further suppressed, such that an S/N ratio of a sound signal output to the input/output interface 25 is further improved.

In the sound emission and collection device of this embodiment as described above, a wraparound sound can be mechanically reduced by making a positional relationship of a speaker and a microphone as described above. A wraparound sound component included in a collected sound signal of each microphone can be effectively suppressed by making a microphone installation pattern as described above, and a wraparound sound component can be further suppressed by performing echo cancellation. Thereby, an excellent S/N ratio can be realized with respect to an output sound signal.

In this embodiment, an example in which the concave portion 11S of the first surface 10A of the case 1S is formed and the microphones 2A~2H are arranged on an inner circumference wall surface 12S of the concave portion 11S has been described, but the microphones 2A~2H can be arranged in the structure shown in FIG. 19.

Figure 19A:
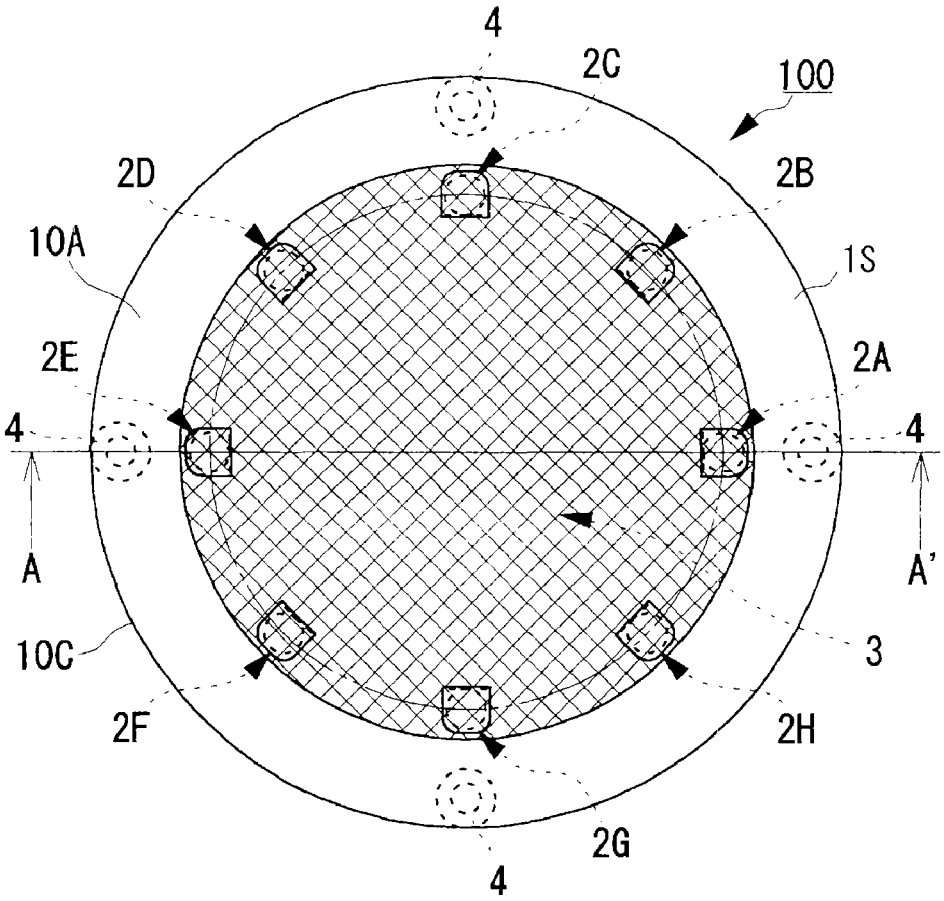
FIG. 19A is a view showing a configuration of main parts of a sound emission and collection device of another configuration of this embodiment.
Figure 19B:
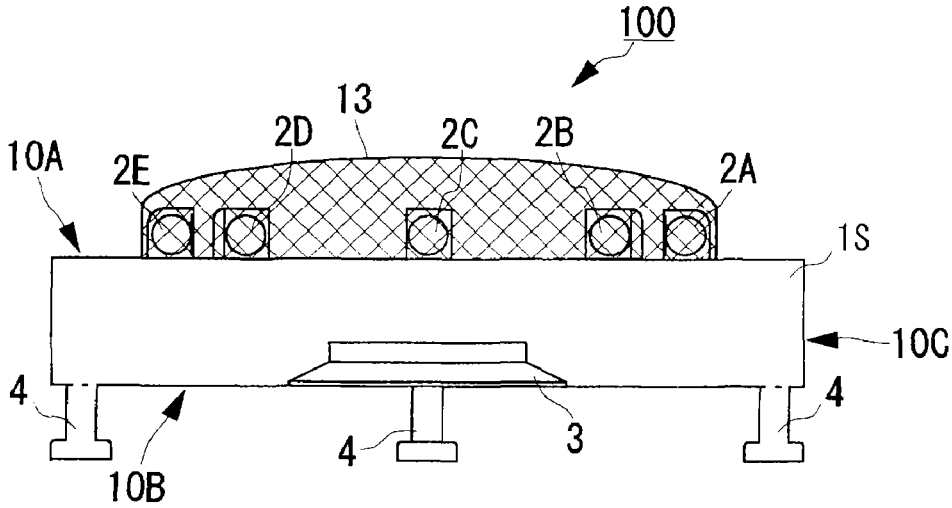
FIG. 19B is a view showing a configuration of main parts of a sound emission and collection device of another configuration of this embodiment.

FIG. 19 is a view showing a configuration of main parts of the sound emission and collection device of another configuration of this embodiment, FIG. 19A is a plan view, and FIG. 19B is an A-A' cross-sectional view in FIG. 19A. In the sound emission and collection device shown in FIG. 19, the microphones 2A~2H are arranged on a first surface 10A, the microphones 2A~2H are covered with a mesh-shaped cover 13, and other configurations are the same as described above. Also in such a configuration, the above-described advantage can be shown.

In this embodiment, the case 1S has been described as an example of a short circular cylindrical shape, but can be an elliptical cylindrical shape of which a plane section is elliptical and can be a rectangular parallelepiped shape.

In this embodiment, an example in which a second surface 10B side having the speaker 3 is arranged facing the top surface of the desk 200 has been shown, but the second surface 10B side having the speaker 3 can be arranged toward the ceiling of a room where the user is located such that the foot portion 4 is connected to the ceiling surface.

In this embodiment, eight microphones and one speaker have been shown, but the number of microphones and the number of speakers can be properly set when the microphone and the speaker are arranged on facing surfaces of the case as described above and the directivity of the microphone is set as described above.

The configuration of the microphone signal processing circuit 23 is not limited to the above-described example.

Figure 20:
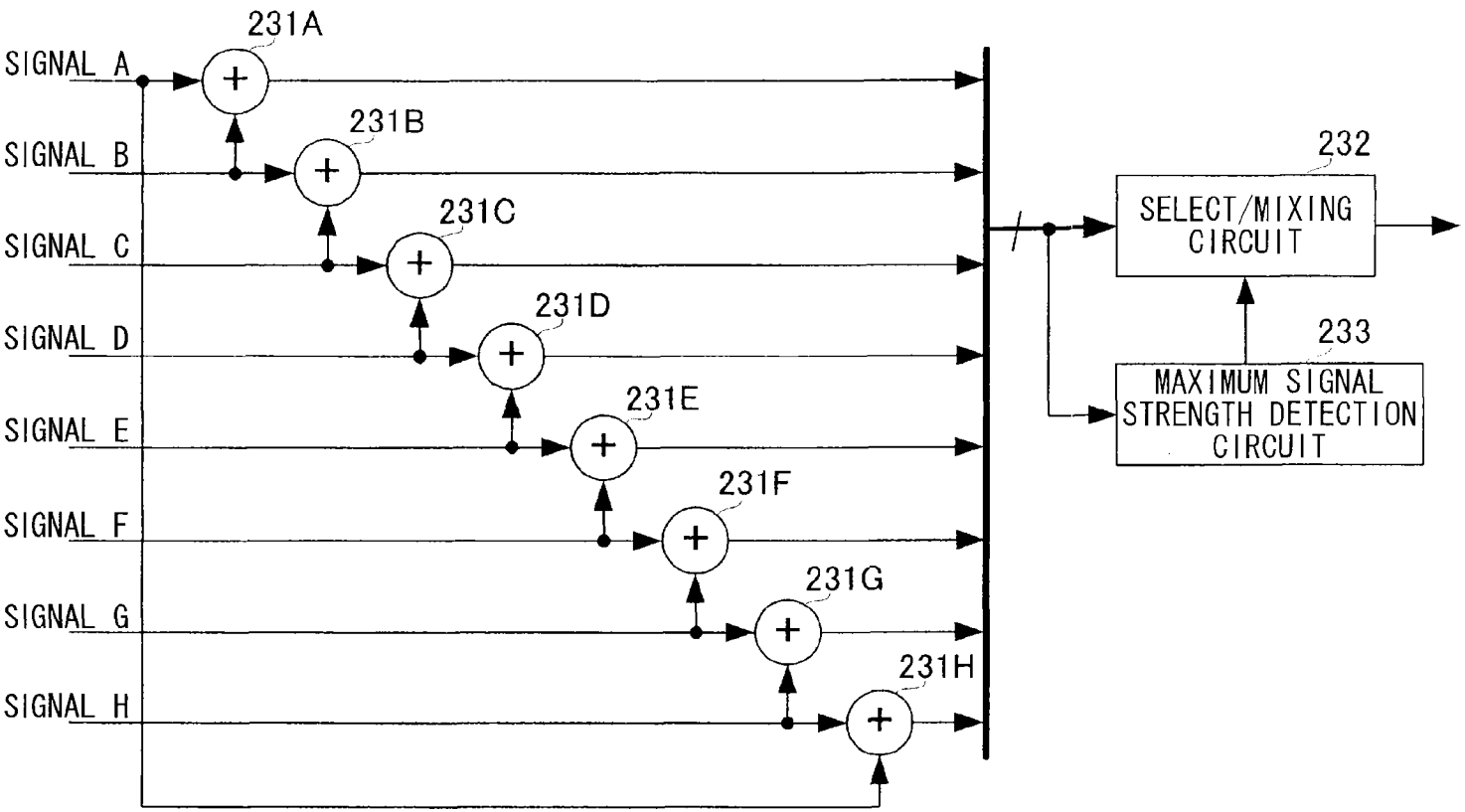
FIG. 20 is a block diagram showing another configuration of the microphone signal processing circuit 23.

FIG. 20 is a block diagram showing another configuration of the microphone signal processing circuit 23. The microphone signal processing circuit 23 shown in FIG. 20 is different from the microphone signal processing circuit 23 shown in FIG. 17 only in terms of a signal synthesis portion.

A signal A output from an A/D converter 22A and a signal B output from an A/D converter 22B are input to an adder 231A. The adder 231A adds and outputs the signal A and the signal B. Similarly, an adder 231B adds and outputs the signal B and a signal C, an adder 231C adds and outputs the signal C and a signal D, and an adder 231D adds and outputs the signal D and a signal E. An adder 231E adds and outputs the signal E and a signal F, an adder 231F adds and outputs the signal F and a signal G, an adder 231G adds and outputs the signal G and a signal H, and an adder 231H adds and outputs the signal H and the signal A. As described above, the microphone signal processing circuit 23 shown in FIG. 20 adds and outputs collected sound signals capable of being obtained from two adjacent microphones. A collected sound signal component can be enhanced in a front direction of the microphone, that is, a direction in which the high sound collection sensitivity is set, by adding collected sound signals of the adjacent microphones, such that collected sound signal components in other directions can be weakened. Thereby, a further enhanced directional signal can be acquired.

The microphone signal processing circuit 23 can be configured as follows.

Figure 21:
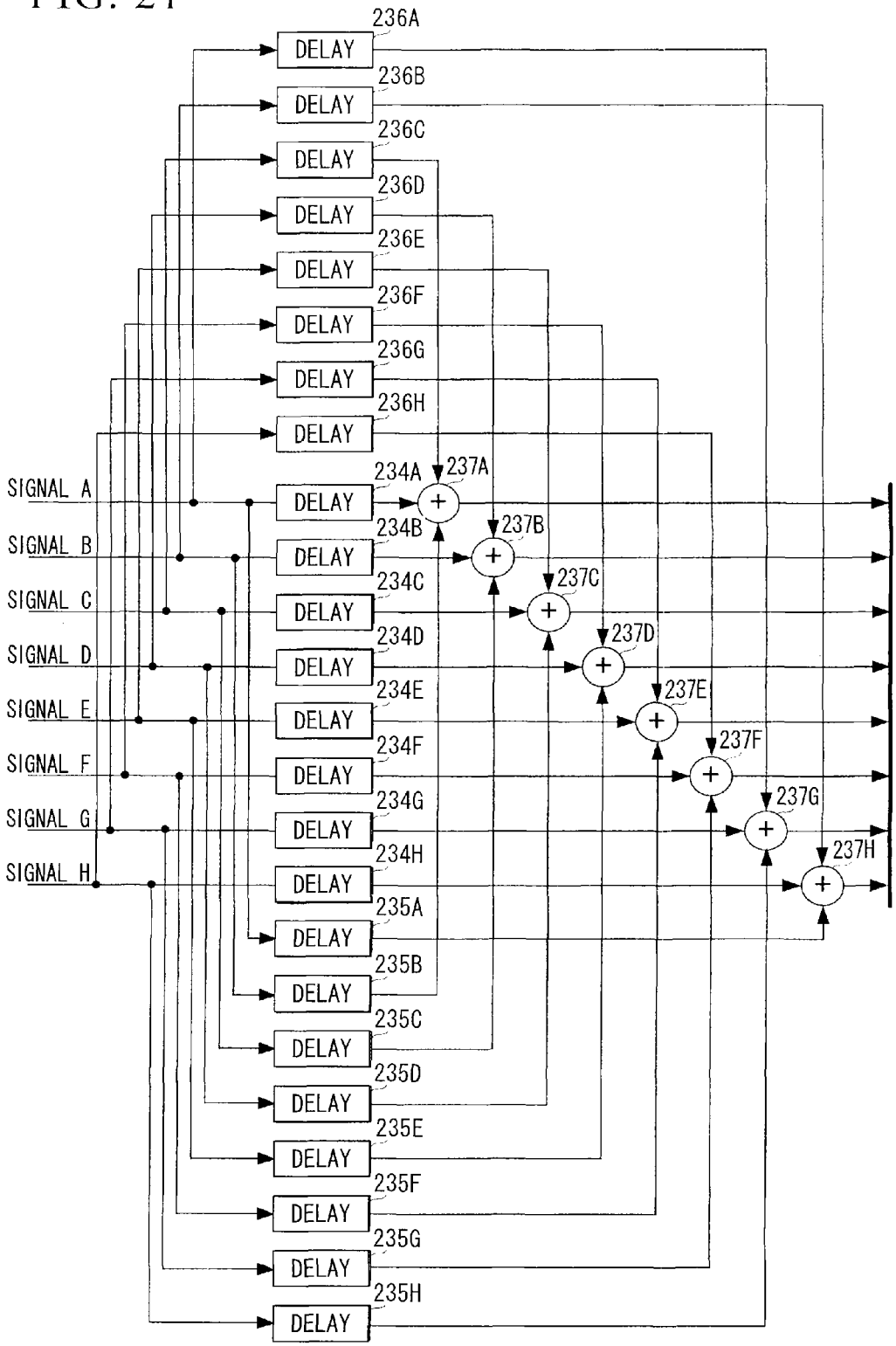
FIG. 21 is a block diagram of a signal synthesis section in a further another microphone signal processing circuit 23.

FIG. 21 is a block diagram of a signal synthesis section in another microphone signal processing circuit 23.

The microphone signal processing circuit 23 shown in FIG. 21 is different from the microphone signal processing circuit 23 shown in FIG. 17 only in terms of the signal synthesis section.

The microphone signal processing circuit 23 shown in FIG. 21 has adders 237A~237H and delay circuits 234A~234H, 235A~235H, 236A~236H. Signals A~H are respectively input to the delay circuits 234A~234H, 235A~235H, 236A~236H. For example, the signal A is input to the delay circuits 234A, 235A, 236A and the other signals B~H are also processed in the same way.

The delay circuits 234A~234H, 235A~235H, 236A~236H perform a delay process for input signals such that three signals input to the adders 237A~237H are in the same phase.

The adder 237A adds an output signal (signal A) of the delay 234A, an output signal (signal B) of the delay 235B, and an output signal (signal C) of the delay 236C and outputs. Similarly, the adder 237B adds the signal B, the signal C, and the signal D for which the delay processes have been respectively applied and outputs, the adder 237C adds the signal C, the signal D, and the signal E for which the delay processes have been respectively applied and outputs, and the adder 237D adds the signal D, the signal E, and the signal F for which the delay processes have been respectively applied and outputs. In addition, the adder 237E adds the signal E, the signal F, and the signal G for which the delay processes have been respectively applied and outputs, the adder 237F adds the signal F, the signal G, and the signal H for which the delay processes have been respectively applied and outputs, the adder 237G adds the signal G; the signal H, and the signal A for which the delay processes have been respectively applied and outputs, and the adder 237H adds the signal H, the signal A, and the signal B for which the delay processes have been respectively applied and outputs. Thereby, collected sound signals from three adjacent microphones are added in the same phase. As a result, the signal strength of a specific direction further increases and the S/N ratio is improved, such that the directivity of the specific direction can further increase. In addition, the number of signals to be added is not limited to three, and the S/N ratio of the specific direction can be improved by adding or subtracting a larger number of signals.

A configuration in which the microphone signal processing circuit 23 shown in FIG. 20 and FIG. 21 directly processes output signals A~H of the A/D converters 22A~22H has been shown, but corrected signals A~H generated using the circuit shown in FIG. 17 can be input. Thereby, the S/N ratio is further improved.

Figure 22A:
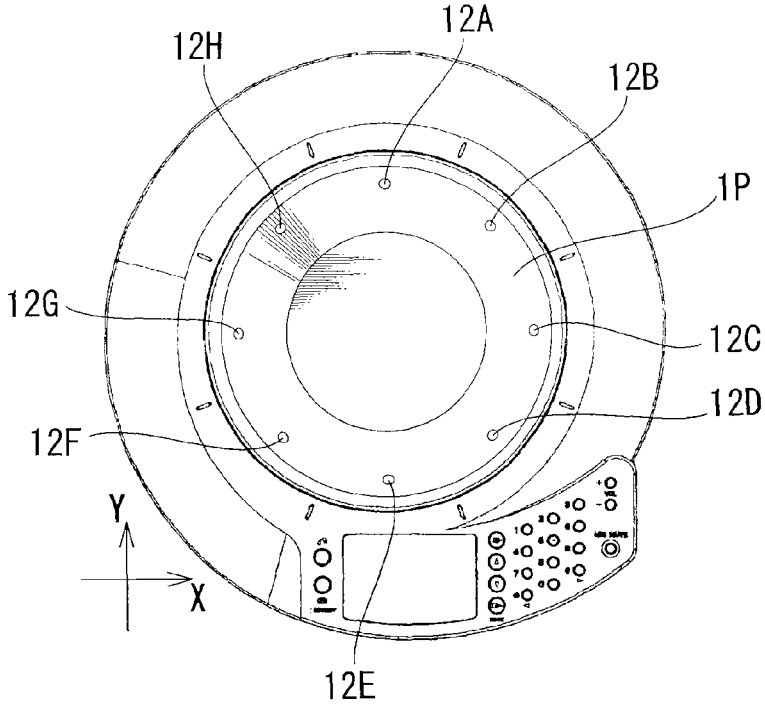
FIG. 22A is a view showing an example of the above-described sound emission and collection device.
Figure 22B:
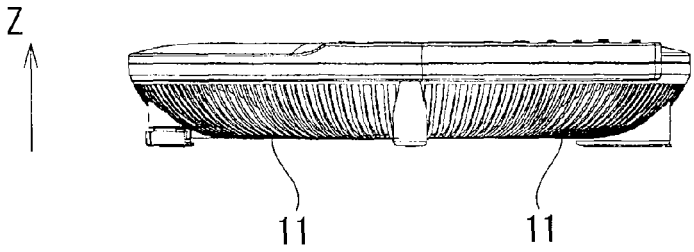
FIG. 22B is a view showing an example of the above-described sound emission and collection device.
Figure 22C:
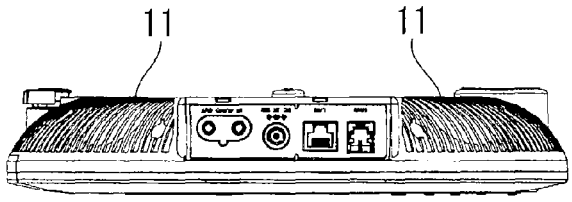
FIG. 22C is a view showing an example of the above-described sound emission and collection device.
Figure 22D:
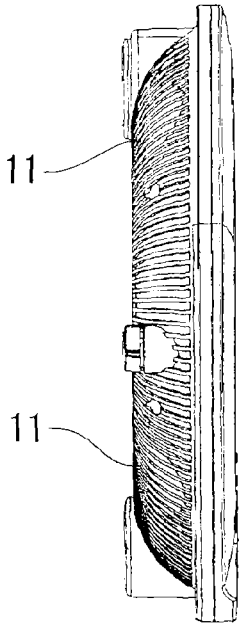
FIG. 22D is a view showing an example of the above-described sound emission and collection device.
Figure 22E:
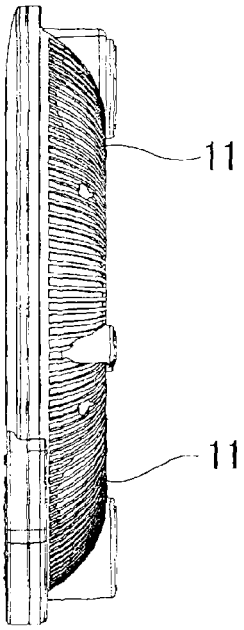
FIG. 22E is a view showing an example of the above-described sound emission and collection device.
Figure 22F:
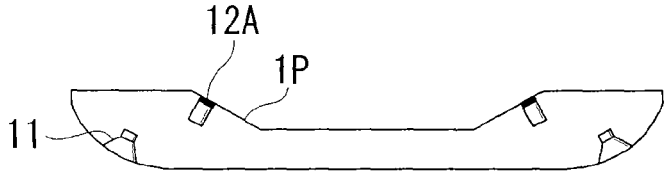
FIG. 22F is a cross-sectional view in an example of the above-described sound emission and collection device.
Figure 23:
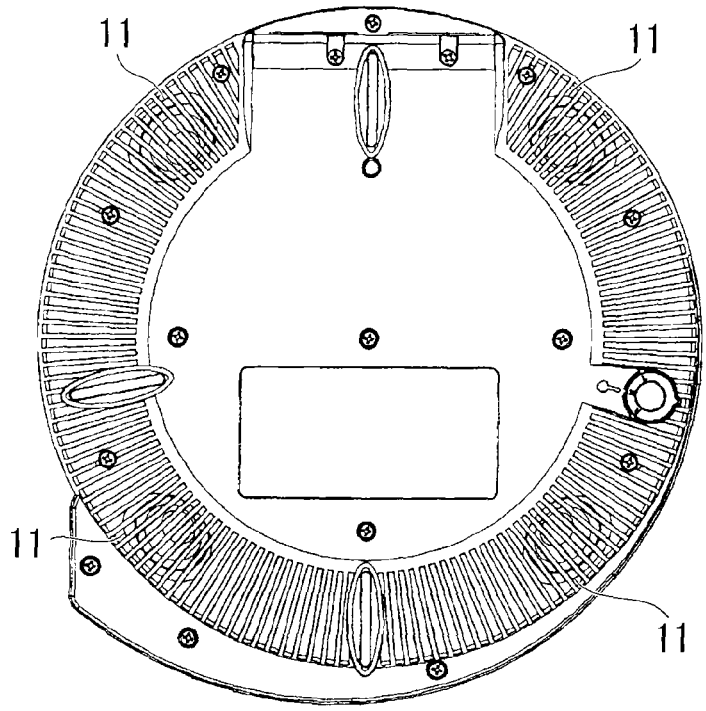
FIG. 23 is a view showing an example of the above-described sound emission and collection device.

FIG. 22A~FIG. 22F and FIG. 23 are views showing an example of the above-described sound emission and collection device. FIG. 22A~FIG. 22E show an upper surface and a side surface of the sound emission and collection device, FIG. 22F is a cross-sectional view of the sound emission and collection device, and FIG. 23 shows a bottom surface of the sound emission and collection device.

In these figures, the speaker 11 of the sound emission and collection device is provided in a curved surface portion across the bottom surface from the side surface. For this reason, there is an advantage in that the speaker is not seen from an upward direction of the sound emission and collection device and the degree of freedom on the design can be improved.

Furthermore, a punching metal 1P of FIG. 22F has an inclined shape in an inner side, such that a cross-section of the sound emission and collection device has a shape in which a center is recessed. As shown in FIG. 22F, the microphones 12A~H are provided inside the punching metal 1P, and, according to this configuration, the microphones 12A~H have the directivity in an inner side direction of the sound emission and collection device and are not visible on an external appearance, such that the degree of freedom on the design can be improved.

In the sound emission and collection device, the sound emission and collection operations can be the same as those of the above-described other embodiments.

INDUSTRIAL APPLICABILITY

According to the present invention, a plurality of microphones and speakers are installed on circumferences of concentric circles such that a sound collection direction and a sound emission direction are opposite directions, thereby providing a compact configuration and improving an S/N ratio by suppressing a wraparound sound from the speaker to the microphone.

According to the present invention, a plurality of unidirectional microphones are arranged in a circumference shape on one side surface of a case and are installed by setting the directivity of the high sensitivity in a center direction of the circle, and the speaker is arranged on the other side surface of the case, such that a propagation distance of a wraparound sound from the speaker to the microphone can be effectively made. Thereby, a compact configuration can be provided and an S/N ratio can be improved by suppressing a wraparound sound from the speaker to the microphone.

The invention claimed is:

1. A sound emission and collection device comprising:

a plurality of unidirectional microphones each having a sound collecting side; and a plurality of speakers each having a sound emitting side, wherein the plurality of unidirectional microphones are circumferentially arranged along a first circle; and wherein the plurality of speakers are circumferentially arranged along a second circle, wherein the second circle is concentric with the first circle, and wherein the sound emitting side of each of the plurality of speakers faces away from the sound collecting side of a neighboring unidirectional microphone among the plurality of unidirectional microphones.

2. The sound emission and collection device according to claim 1, wherein the first circle has a larger diameter than the second circle.

3. The sound emission and collection device according to claim 1, further comprising:

a case on which the plurality of unidirectional microphones and the plurality of speakers are arranged, wherein the plurality of unidirectional microphones are arranged on an upper surface of the case, and wherein the plurality of speakers are arranged on a side surface side of the case.

4. The sound emission and collection device according to claim 1, further comprising a signal processor that estimates a sound source direction based on a level of a sound signal collected by each unidirectional microphone and outputs the collected sound signal toward the sound source direction.

5. The sound emission and collection device according to claim 4, wherein the signal processing processor estimates a sound source direction by adding the sound signals collected by a plurality of adjacent unidirectional microphones and outputs a signal achieved by adding the collected sound signals.

6. A sound emission and collection device comprising:

a case comprising first and second surfaces that are parallel to each other;

a plurality of unidirectional microphones circumferentially arranged along a circle on the first surface, each of the unidirectional microphones having a directional axis extending toward a center of the circle and point-symmetrically arranged around the center of the circle as a reference point;

a speaker having a sound emission surface parallel to the second surface while a center of the sound emission surface and the center of the circle intersect a line perpendicular to the first and second surfaces, and emitting a sound from the second surface to outside the case; and a signal processor that executes an adding operation of adding the sound signal collected by one unidirectional microphone among the plurality of unidirectional microphones and the sound signal collected by other unidirectional microphones that are adjacent to the one unidirectional microphone among the plurality of microphones, wherein the signal processor executes the adding operation for each of the plurality of unidirectional microphones and determines a direction of a sound source based on a signal strength of the collected sound signals that have been added by the adding operation.

7. The sound emission and collection device according to claim 6, wherein the signal processor generates a difference-corrected collected sound signal by performing a difference arithmetic operation on the collected sound signal of each unidirectional microphone.

8. The sound emission and collection device according to claim 7, wherein the signal processor detects the sound source direction based on the signal strength of the difference-corrected collected sound signal and outputs the difference-corrected collected sound signal corresponding to the sound source direction.

9. The sound emission and collection device according to claim 1, wherein the second circle has a larger diameter than the first circle.

* * * * *

UNITED STATES PATENT AND TRADEMARK OFFICE

CERTIFICATE OF CORRECTION

PATENT NO. : 8,243,951 B2
APPLICATION NO. : 12/095652
DATED : August 14, 2012
INVENTOR(S) : Toshiaki Ishibashi et al.

It is certified that error appears in the above-identified patent and that said Letters Patent is hereby corrected as shown below:

Delete the title page and substitute therefore the attached title page showing the corrected number of claims in patent.

Column 22, line 45-Column 23, line 23, delete claims 1-5.

Column 24, lines 24-26, delete claim 9.

Signed and Sealed this
Twentieth Day of November, 2012

David J. Kappos

David J. Kappos
*Director of the United States Patent and Trademark Office*

(12) United States Patent
Ishibashi et al.

(10) Patent No.: US 8,243,951 B2
(45) Date of Patent: Aug. 14, 2012

(54) SOUND EMISSION AND COLLECTION DEVICE

(75) Inventors: Toshiaki Ishibashi, Fukuroi (JP); Kosuke Saito, Hamamatsu (JP)

(73) Assignee: Yamaha Corporation (JP)

( * ) Notice: Subject to any disclaimer, the term of this patent is extended or adjusted under 35 U.S.C. 154(b) by 995 days.

(21) Appl. No.: 12/095,652

(22) PCT Filed: Dec. 15, 2006

(86) PCT No.: PCT/JP2006/325063

§ 371 (c)(1),
(2), (4) Date: May 30, 2008

(87) PCT Pub. No.: WO2007/072757

PCT Pub. Date: Jun. 28, 2007

(65) Prior Publication Data

US 2010/0166212 A1 Jul. 1, 2010

(30) Foreign Application Priority Data

Dec. 19, 2005 (JP) ..... 2005-364617
Dec. 21, 2005 (JP) ..... 2005-368052

(51) Int. Cl.
*H04R 3/00* (2006.01)

(52) U.S. Cl. ..... 381/92

(58) Field of Classification Search ..... None
See application file for complete search history.

(56) References Cited

U.S. PATENT DOCUMENTS 2,424,634 A * 7/1947 Rieber ..... 381/66
3,694,578 A 9/1972 Reid
5,778,085 A 7/1998 Sasaki
6,173,059 B1 1/2001 Huang et al.
2004/0252849 A1* 12/2004 Johnston et al. ..... 381/92
2005/0093970 A1 5/2005 Abe et al.
2005/0094795 A1 5/2005 Rambo
2006/0132595 A1* 6/2006 Kenoyer et al. ..... 348/14.08
2007/0025560 A1* 2/2007 Asada ..... 381/61

FOREIGN PATENT DOCUMENTS

JP 56-39667 A 4/1981
JP 58-56563 A 4/1983
JP 61-035699 A 2/1986

(Continued)

OTHER PUBLICATIONS

Japanese Office Action corresponding to JP 2005-364617, mailed Apr. 19, 2011. English language translation provided.
Japanese Office Action corresponding to JP 2005-368052, mailed Apr. 26, 2011. English language translation of Japanese OA provided. References in OA previously cited in IDS dated Jun. 19, 2008.
International Search Report issued in corresponding PCT/JP2006/325063. No English translation readily available.

(Continued)

*Primary Examiner* — Hrayr A Sayadian
(74) *Attorney, Agent, or Firm* — Rossi, Kimms & McDowell LLP

(57) ABSTRACT

It is possible to provide a sound emission and collection device having a compact configuration and being capable of suppressing a wraparound sound from a speaker to a microphone and improving the S/N ratio. In the sound emission and collection device, a plurality of speakers (11) have a sound emission surface arranged on the side surface of a case (1) so that a sound can be emitted in all circumferential directions of the sound emission and collection device. Each of the microphones (12) is arranged with the sound collection direction set in the center direction of the case (1). The microphone (12) and the speaker (11) have directivities opposing to each other. Accordingly, it is possible to minimize a wraparound sound from the speaker (11) to the microphone (12). Moreover, since the speaker (11) and the microphone (12) are arranged on circumferences of concentric circles, it is possible to obtain a compact configuration.

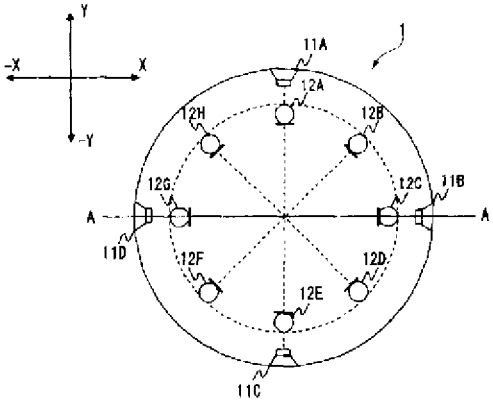

3 Claims, 24 Drawing Sheets